US007583016B2

(12) United States Patent
Nishimura et al.

(10) Patent No.: US 7,583,016 B2
(45) Date of Patent: Sep. 1, 2009

(54) PRODUCING METHOD FOR ELECTRON-EMITTING DEVICE AND ELECTRON SOURCE, AND IMAGE DISPLAY APPARATUS UTILIZING PRODUCING METHOD FOR ELECTRON-EMITTING DEVICE

(75) Inventors: Michiyo Nishimura, Sagamihara (JP); Yoji Teramoto, Ebina (JP); Ryoji Fujiwara, Chigasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 497 days.

(21) Appl. No.: 11/296,462

(22) Filed: Dec. 8, 2005

(65) Prior Publication Data

US 2006/0125370 A1 Jun. 15, 2006

(30) Foreign Application Priority Data

Dec. 10, 2004 (JP) ..... 2004-358362

(51) Int. Cl.
*H01J 1/304* (2006.01)
*H01J 1/02* (2006.01)

(52) U.S. Cl. ..... 313/311; 313/495; 313/310; 445/50; 445/51

(58) Field of Classification Search ..... 313/495–497, 313/309–311; 445/50, 51
See application file for complete search history.

(56) References Cited

U.S. PATENT DOCUMENTS

| | | | | |
|---|---|---|---|---|
| 4,663,559 | A | 5/1987 | Christensen | 313/336 |
| 4,904,895 | A | 2/1990 | Tsukamoto et al. | 313/336 |
| 5,180,951 | A | 1/1993 | Dworsky et al. | 315/169.3 |
| 5,283,501 | A | 2/1994 | Zhu et al. | 315/169.3 |
| 5,786,658 | A | 7/1998 | Tsukamoto et al. | 313/309 |
| 5,861,707 | A | 1/1999 | Kumar | 313/309 |
| 5,939,823 | A | 8/1999 | Kiyomiya et al. | 313/495 |
| 5,952,772 | A | 9/1999 | Fox et al. | 313/310 |
| 5,986,857 | A | 11/1999 | Hirano et al. | 360/113 |
| 5,989,404 | A | 11/1999 | Kiyomiya et al. | 205/96 |
| 6,008,502 | A * | 12/1999 | Deguchi et al. | 257/10 |
| 6,097,139 | A | 8/2000 | Tuck et al. | 313/310 |

(Continued)

FOREIGN PATENT DOCUMENTS

EP 0 290 026 A1 11/1988

(Continued)

OTHER PUBLICATIONS

Zhirnov et al., "Environmental Effect on the Electron Emission from Diamond Surfaces", J. Vac. Technol. B., 16(3), pp. 1188-1193 (1998).

(Continued)

*Primary Examiner*—Karabi Guharay
(74) *Attorney, Agent, or Firm*—Fitzpatrick, Cella, Harper & Scinto

(57) ABSTRACT

The invention is to provide a producing method for an electron emitting device of field emission type, having sufficient on/off characteristics and capable of efficient electron emission at a low voltage. There is provided a producing method for an electron emitting device including steps of preparing a plurality of electroconductive particles each covered with an insulation material having a thickness of 10 nm or less at least on a part of a surface of the particle, and forming a dipole layer on a surface of the insulation material covering each of the plurality of electroconductive particles.

10 Claims, 14 Drawing Sheets

U.S. PATENT DOCUMENTS

| | | | | |
|---|---|---|---|---|
| 6,129,602 | A | 10/2000 | Yamanobe | 445/24 |
| 6,267,636 | B1 | 7/2001 | Onishi et al. | 445/6 |
| 6,288,494 | B1 | 9/2001 | Tsukamoto et al. | 315/169.1 |
| 6,379,211 | B2 | 4/2002 | Onishi et al. | 445/73 |
| 6,435,928 | B1 | 8/2002 | Tsukamoto | 445/24 |
| 6,515,640 | B2 | 2/2003 | Tsukamoto et al. | 345/75.2 |
| 6,583,553 | B2 | 6/2003 | Sasaguri | 313/495 |
| 6,583,582 | B2 | 6/2003 | Ichikawa | 315/169.3 |
| 6,624,589 | B2 | 9/2003 | Kitamura et al. | 315/169.3 |
| 6,650,061 | B1 | 11/2003 | Urayama et al. | 315/169.3 |
| 6,683,408 | B2 | 1/2004 | Ichikawa | 313/495 |
| 6,686,679 | B1 * | 2/2004 | Tuck et al. | 313/309 |
| 6,717,340 | B2 | 4/2004 | Nishimura | 313/310 |
| 6,828,728 | B2 | 12/2004 | Ishii et al. | 313/512 |
| 6,840,835 | B1 * | 1/2005 | Tuck | 445/50 |
| 6,861,790 | B1 | 3/2005 | Iwasa et al. | 313/346 R |
| 6,876,007 | B2 | 4/2005 | Yamazaki et al. | 257/88 |
| 6,933,664 | B2 | 8/2005 | Kitamura et al. | 313/309 |
| 6,975,288 | B2 | 12/2005 | Nishimura et al. | 345/74.1 |
| 7,021,981 | B2 | 4/2006 | Onishi et al. | 445/6 |
| 7,074,102 | B2 | 7/2006 | Teramoto | 445/24 |
| 7,109,663 | B2 | 9/2006 | Fujiwara et al. | 315/169.4 |
| 7,259,520 | B2 | 8/2007 | Fujiwara et al. | 315/169.1 |
| 2002/0047562 | A1 | 4/2002 | Kitamura et al. | 315/169.3 |
| 2002/0057045 | A1 | 5/2002 | Tsukamoto | 313/309 |
| 2002/0097204 | A1 | 7/2002 | Tsukamoto et al. | 345/74.1 |
| 2003/0209992 | A1 | 11/2003 | Kitamura et al. | 315/169.3 |
| 2004/0251812 | A1 | 12/2004 | Fujiwara et al. | 313/495 |
| 2005/0017651 | A1 * | 1/2005 | Nishimura | 315/169.3 |
| 2005/0202745 | A1 | 9/2005 | Nishimura | 445/5 |
| 2006/0061289 | A1 | 3/2006 | Fujiwara et al. | 315/169.1 |
| 2006/0066199 | A1 | 3/2006 | Ichikawa et al. | 313/311 |
| 2006/0252335 | A1 | 11/2006 | Onishi et al. | 445/6 |
| 2007/0054585 | A1 | 3/2007 | Teramoto | 445/51 |
| 2008/0012463 | A1 | 1/2008 | Fujiwara et al. | 313/310 |
| 2008/0070468 | A1 | 3/2008 | Ichikawa et al. | 445/51 |

FOREIGN PATENT DOCUMENTS

| | | | |
|---|---|---|---|
| EP | 1 177 568 | | 2/2000 |
| EP | 1 056 110 | A1 | 11/2000 |
| EP | 1 160 819 | A2 | 12/2001 |
| GB | 2304989 | A * | 3/1997 |
| JP | 4-131846 | | 5/1992 |
| JP | 8-96703 | | 4/1996 |
| JP | 8-96704 | | 4/1996 |
| JP | 8-264109 | | 10/1996 |
| JP | 2654012 | | 5/1997 |
| JP | 9-199001 | | 7/1997 |
| JP | 10-223130 | | 8/1998 |
| JP | 11-510307 | | 9/1999 |
| JP | 2001-6523 | | 1/2001 |
| JP | 2001-101966 | | 4/2001 |
| JP | 2001-202870 | | 7/2001 |
| JP | 2002-56771 | | 2/2002 |
| JP | 2002-93305 | | 3/2002 |
| JP | 2002-522878 | | 7/2002 |
| JP | 2002-373569 | | 12/2002 |
| JP | 2003-500795 | | 1/2003 |
| JP | 2003-51243 | | 2/2003 |
| JP | 2002-92056 | | 3/2003 |
| WO | WO 99/28939 | | 6/1999 |
| WO | WO 00/10190 | | 2/2000 |
| WO | WO 00/70638 | | 11/2000 |
| WO | WO 03/046255 | A1 | 6/2003 |
| WO | WO 03/107377 | A1 | 12/2003 |

OTHER PUBLICATIONS

Robertson, "Mechanisms of Electron Filed Emission from Diamond, Diamond-like Carbon, and Nanostructured Carbon", J. Vac. Scie, Technol., B 17(2), pp. 659-665 (1999).

Hart et al., "Field Emission from Tetrahedral Amorphous Carbon as a Function of Surface Treatment and Substrate Material", Appl. Phys. Lett., vol. 74, No. 11, pp. 1594-1596 (1999).

Robertson, "Amorphous Carbon Cathodes for Field Emission Display", Thin Solid Films, 296, pp. 61-65 (1997).

Forbes,"Low-macroscopic-field Electron Emission from Carbon Films and Other Electrically Nanostructured Heterogeneous Materials: Hypotheses About Emission Mechanism", Solid-state Electronics, 45, pp. 779-808 (2001).

Pierson, "Diamond-Like Carbon (DLC)", Handbook of Carbon, Graphite, Diamond and Fullerenes: Properties, Processing and Applications, Noyers Publications, USA, pp. 337- 355 (1993).

Forest et al., "A Study of Electron Field Emission as A Function of Film Thickness from Amorphous Carbon Films", Applied Physics Letters, vol. 73, No. 25, pp. 3784-3786 (1998).

Ding et al., "Electron Field Emission from Ti-containing Tetrahedral Amorphous Carbon Films Deposited by Filtered Cathodic Vacuum Arc", Journal of Applied Physics, vol. 88, No. 11, pp. 6842-6847 (2000).

Li et al., "Field Emission from Cobalt-containing Amorphous Carbon Composite Films Heat-treated in An Acetylene Ambient", Applied Physics Letters, vol. 77, No. 13, pp. 2021- 2023 (2000).

Lau et al., "Field Emission from Metal-containing Amorphous Carbon Composite Films", Diamond and Related Materials, 10, pp. 1727-1731 (2001).

Bajic et al., "Enhanced Cold-cathode Emission Using Composite Resin-carbon Coatings", J. Phys. D: Appl. Phys., 21, pp. 200-204 (1988).

Burden et al., "Field Emitting Inks for Consumer-priced Broad-area Flat-panel Displays", J. Vac. Sci. Technol. B 18(2), pp. 900-904 (2000).

* cited by examiner

PRODUCING METHOD FOR ELECTRON-EMITTING DEVICE AND ELECTRON SOURCE, AND IMAGE DISPLAY APPARATUS UTILIZING PRODUCING METHOD FOR ELECTRON-EMITTING DEVICE

BACKGROUND OF THE INVENTION

1. Field of the Invention

The present invention relates to a producing method for an electron emitting device of field emission type, a producing method for an electron source formed by arranging a plurality of the electron emitting devices, and a producing method for an image display apparatus, such as a television, formed by employing the electron source.

2. Related Background Art

An electron-emitting device includes, for example, a field emission type (hereinafter called FE type) and a surface conduction type.

The electron-emitting device of FE type is of a type in which a voltage is applied between a cathode electrode (and an electron-emitting film provided thereon) and a gate electrode thereby extracting, by such voltage (electric field), electrons from the cathode electrode into a vacuum space. Therefore an operating electric field is significantly influenced by a work function and a shape of the cathode (electron emitting film) to be employed, and it is generally considered necessary to select a cathode electrode (electron-emitting film) of a low work function.

For example a patent reference 1 discloses an electron-emitting apparatus provided with a metal member serving as a cathode electrode and a semiconductor (such as diamond, AlN or BN) adjoined to the metal member. This reference also discloses a hydrogen termination of a surface of a semiconductor film formed by diamond and having a film thickness of about 10 nm or less. FIG. 13 is an energy band diagram showing an electron-emitting principle of the electron-emitting device disclosed in the patent reference 1, wherein shown are a cathode electrode 1, a semiconductor film 141, an extraction electrode (gate electrode or anode electrode) 3, a vacuum barrier 4 and an electron 6.

Diamond is a representative material having a negative electron affinity, and an electron-emitting device utilizing a diamond surface having a negative electron affinity (NEA) as an electron emitting surface is disclosed in patent references 2, 3 and a non-patent reference 1. Also a patent reference 4 discloses an electron-emitting device in which conductive particles are embedded in a layer of an inorganic electrical insulating material or are coated by a layer of an insulating material.

Patent Reference 1: Japanese Patent Application Laid-open No. H9-199001

Patent Reference 2: U.S. Pat. No. 5,283,501

Patent Reference 3: U.S. Pat. No. 5,180,951

Patent Reference 4: Japanese PCT Translation No. H11-510307

Non-patent Reference 1: V. V. Zhinov, J. Liu et al., Environmental effect on the electron emission from diamond surfaces, J. Vac. Sci. Technol., B16(3), May/June 1998, pp. 1188-1193

SUMMARY OF THE INVENTION

Aforementioned prior electron-emitting devices utilizing diamond or the like enable an electron emission at a low threshold electric field and a large emission current. On the other hand, in case a semiconductor having a negative electron affinity or a very small positive electron affinity is employed in an electron-emitting device, electrons once injected into the semiconductor are almost surely emitted. Because of such property of very easily emitting the electrons, it may become very difficult, in an application to a display or an electron source, to control the electron emission amount (particularly on-off switching) from each electron-emitting device.

In an electron source having a matrix array of the FE type electron emitting devices or a display (FED) utilizing such electron source with matrix array, each electron-emitting device is connected to one of plural X-direction wirings (scanning wirings to which a scanning signal is applied) and to one of plural Y-direction wirings (signal wirings to which a modulated signal is applied). In case of executing so-called "line-sequential drive" line by line, a scanning signal is applied to a desired X-direction wiring selected from the plural X-direction wirings, and, in synchronization therewith, a modulation signal is applied to a Y-direction wiring connected to a desired electron-emitting device, among the plural electron-emitting devices connected to the selected X-direction wiring. Such operation is conducted in succession to other X-direction wirings thereby achieving the "line-sequential drive" line by line. In such "line-sequential drive", the drive is not limited to a drive line by line (one by one) but plural lines may be activated simultaneously.

In such "line-sequential drive", among the non-selected electron-emitting devices (those connected to the non-selected scanning wirings (X-direction wirings)), certain electron-emitting devices may receive a non-zero voltage (typically a half of the driving voltage applied to the selected electron emitting-device). This is because the electron emitting-devices connected to the non-selected scanning wirings (X-direction wirings) include those connected to the signal wiring (Y-direction wiring) which receives the above-mentioned modulation signal. Such state of the non-selected electron-emitting device, receiving a non-zero voltage lower than the driving voltage at the selected state, is called a "half-selection" state. Also a voltage applied to the electron-emitting device of such "half-selection" state is called a "half-selection voltage". Also a current emitted from the electron-emitting device of such "half-selection" state and/or a current flowing in the electron-emitting device of such "half-selection" state is called a "half-selection current". A current emitted from a selected electron-emitting device and/or a current flowing in the selected electron-emitting device is called a "selection current", and a ratio of the "half-selection current" and the "selection current" is called a "half-selection current ratio".

The aforementioned "half-selection current" tends to appear in case electron-emitting devices, utilizing the aforementioned semiconductor having the negative electron affinity or the very small positive electron affinity, are arranged in the matrix array and are line-sequentially driven to realize a matrix electron source or an image display apparatus such as a television. Consequently, in an application to the image display apparatus such as television, an unintended pixel (light-emitting member) causes a light emission with an unintended light intensity thereby reducing a contrast of a displayed image.

In the following, there will be explained a "half-selection current" relating to the contrast. A field emission current J from an FE type electron emitting device can be represented, according to a Fowler-Nordheim model, by the following equation:

$$J = \frac{AE^2}{\Phi t}\exp\left(-B\frac{\Phi^{1.5}}{E}v\right) \approx \frac{A(V\beta)^2}{\Phi t}\exp\left(-B\frac{\Phi^{1.5}}{V\beta}\right) \quad (1)$$

wherein A, B: constants, Φ: barrier height (corresponding to electron affinity), V: applied voltage, and β: electric field amplifying factor. Therefore the half-selection current $J_{half}$ becomes:

$$J_{half} \approx \frac{A(V\beta)^2}{4\Phi t}\exp\left(-B\frac{2\Phi^{1.5}}{V\beta}\right) \quad (2)$$

and the half-selection current ratio becomes:

$$\frac{J_{half}}{J} \approx \frac{\frac{A(V\beta)^2}{4\Phi t}\exp\left(-B\frac{2\Phi^{1.5}}{V\beta}\right)}{\frac{A(V\beta)^2}{\Phi t}\exp\left(-B\frac{\Phi^{1.5}}{V\beta}\right)} = \frac{1}{4}\exp\left(-B\frac{\Phi^{1.5}}{V\beta}\right). \quad (3)$$

The "half-selection current ratio" mentioned above corresponds to a contrast in a display, between a display portion (light emitting portion) and a non-display portion (light non-emitting portion). For example in a display, it is important to have a contrast ratio at least of 1/1000. In case of realizing a contrast ratio of 1/1000, assuming that all the electrons obtained by a field emission from a cathode electrode (or an electron emitting film) contribute to the light emission of a light emitting member, the "half-selection current ratio" is represented by:

$$\frac{1}{1000} > \frac{1}{4}\exp\left(B\frac{\Phi^{1.5}}{V\beta}\right) \quad (4)$$

and $$B\frac{\Phi^{1.5}}{V\beta} > 5.5. \quad (5)$$

As will be apparent from the relation (5), for obtaining a contrast ratio of at least 1/1000, V and β are preferably smaller and Φ is preferably larger. Also in case of employing a material with a negative electron affinity, the relation (5) cannot be satisfied and a sufficient contrast cannot be realized. FIG. 14 shows a relation between Vβ and $\Phi^{1.5}/V\beta$ at different values of Φ.

In the foregoing, there has been explained a situation where all the electrons emitted from the cathode electrode (or electron-emitting film) become an emission current. However, also in a case where a part (or all) of the emitted electrons flows to the gate electrode or the like in the "half-selection" state, there are encountered drawbacks not only of an increased electric power consumption of the apparatus but also of a situation where so-called "line-sequential" drive becomes practically unrealizable.

In the foregoing there have been explained drawbacks when the electron-emitting devices are matrix driven, but the electron-emitting device utilizing the semiconductor of a negative electron affinity is also associated with another drawback. As the above-described electron-emitting device has a very low threshold field, it is exposed to a high electric field induced by a potential of an anode electrode, in case the anode electrode and the electron-emitting device are opposed as in an image display apparatus. Therefore, in a simple opposed arrangement of an anode electrode and an electron-emitting device, even a non-selected electron-emitting device with a zero voltage applied between the cathode electrode and the gate may easily show an electron emission by an electric field induced by the potential of the anode electrode. As a result, as in the aforementioned case of line-sequential drive, the on/off contrast may become deficient and may hinder the function as the image display apparatus.

An object of the present invention is to solve the aforementioned problems and to provide a simple producing method for an electron-emitting device showing sufficient on/off characteristics and capable of a highly efficient electron emission with a low voltage. Another object is to provide a producing method for an image display apparatus (particularly a flat panel television) showing a high contrast and employing an electron source, utilizing such producing method for the electron emitting device.

The present invention is to attain the aforementioned objects and is to provide a producing method for an electron-emitting device comprising steps of:

preparing a plurality of electroconductive particles each covered with an insulation layer having a thickness of 10 nm or less at least on a part of a surface of the particle; and forming a dipole layer on a surface of the insulating material covering each of the plurality of the electroconductive particles.

The present invention is also characterized in that the insulation layer is a layer principally constituted of carbon.

The present invention is further characterized in that a material constituting the insulation layer has a resistivity of $1\times10^8$ Ω·cm or higher.

The present invention is further characterized in that a material constituting the insulation layer has a resistivity of $1\times10^{14}$ Ω·cm or lower.

The present invention is further characterized in that the electroconductive particles are metal particles.

The present invention is further characterized in that the plurality of electroconductive particles has a density of $10^4$ particle/mm$^2$ or higher.

The present invention is further characterized in that the plurality of electroconductive particles has a density of $10^6$ particle/mm$^2$ or higher.

The present invention is further characterized in that the step of preparing the plurality of electroconductive particles each covered with the insulation layer includes a step of preparing a resin layer containing an electroconductive material and a step of causing the resin layer containing the electroconductive material to constitute an insulation layer containing electroconductive particles.

The present invention is further characterized in that the dipole layer is formed by executing a hydrogen terminating process on a surface of the insulation layer.

The present invention is further characterized by a producing method for an electron source including a plurality of the electron emitting device produced by the aforementioned producing method, and a producing method for an image display apparatus utilizing the producing method for the electron source.

The producing method of the present invention for the electron emitting device allows to produce relatively inexpensively and reproducibly an electron emitting device of field emission type having sufficient on/off characteristics and capable of an efficient electron emission at a low voltage. Also the producing method of the present invention for the electron emitting device may be applied to realize a display (typically a flat panel television) having a high luminance and a high contrast.

DETAILED DESCRIPTION OF THE PREFERRED EMBODIMENTS

Figure 1A:
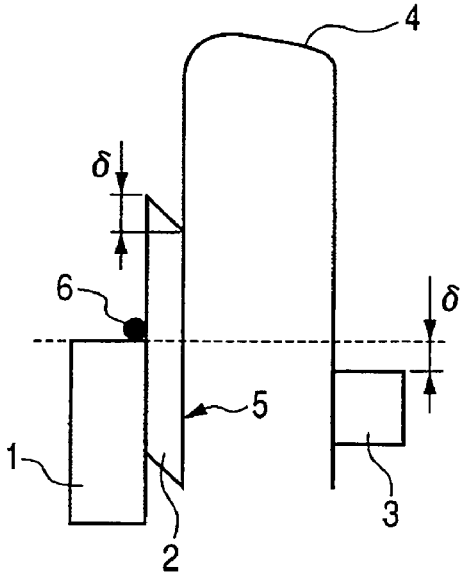
FIGS. 1A and 1B are energy band diagrams for explaining an electron emitting principle of an electron emitting device of the present invention.

The present invention allows, in an array of plural electron emitting devices of a low threshold electric field (electric field strength required for initiating electron emission) on a substrate and selectively driving such devices in a matrix drive as explained before, to improve the controllability of such devices while exploiting the excellent electron emitting property thereof. More specifically, the present invention is to provide a producing method for an electron-emitting device capable of extracting electrons from an electron-emitting material into a vacuum atmosphere (an atmosphere with a pressure lower than the normal atmospheric pressure), utilizing a quantum mechanical tunneling phenomenon of carriers in an insulation layer and a tunneling phenomenon of a vacuum barrier lowered by a hydrogen termination of an electron-emitting material.

An electron-emitting device in which the present invention is applicable is provided, in a basic configuration, with (A) a cathode electrode, (B) plural electroconductive particles electrically connected with the cathode electrode, (C) an insulation layer covering at least a part of a surface of the electroconductive particles and having a dipole layer on a surface, and (D) an extraction electrode (gate electrode and/of anode electrode).

In the following, an embodiment of the electron-emitting device, in which the present invention is applicable, will be explained in detail with reference to the accompanying drawings. However a dimension, a material, a shape and a relative positioning of components described in this embodiment are not to be construed to limit the scope of the present invention to such description unless specified otherwise.

An electron-emitting principle, in the electron-emitting device in which the present invention is applicable, will be explained in a simplified manner with reference to FIGS. 1A and 1B, in which shown are a cathode electrode 1, an insulation layer 2, an extraction electrode 3, a vacuum barrier 4, an interface 5 between the insulation layer 2 on which a dipole layer is formed and vacuum, and an electron 6.

A driving voltage for extracting the electron 6 from the cathode electrode 1 into the vacuum space is a voltage between the cathode electrode 1 and the extraction electrode 3 in a state where a potential higher than that of the cathode 1 is applied to the extraction electrode 3.

Figure 1B:
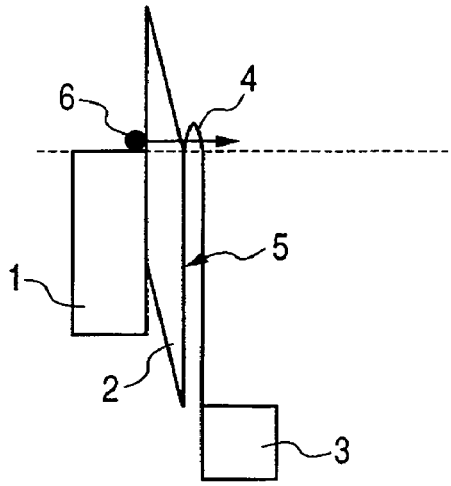

FIG. 1A is an energy band diagram in a state where the electron-emitting device, to which the present invention is applicable, has a driving voltage of 0 [V], and FIG. 1B is an energy band diagram when a driving voltage V [V] is applied. In FIG. 1A, the insulation layer 2 is in a state polarized by the dipole layer formed on the surface and thus being applied by a voltage δ. When a voltage V [V] is further applied to this state, the energy band of the insulation layer 2 assumes a steeper bending, and the vacuum barrier also assumes a steeper bending at the same time. In this state, the potential of the vacuum barrier 4 in contact with the dipole layer is higher than that of the conduction band on the surface of the insulation layer 2 (cf. FIG. 1B). In such state, the electron 6 injected from the cathode electrode 1 tunnels through the insulation layer 2 and the vacuum barrier 4 and is emitted into the vacuum space. In the electron emitting device in which the present invention is applicable, the driving voltage (voltage between the cathode electrode and the gate electrode) is preferably 50 [V] or less, and more preferably from 5 to 50 [V].

Figure 2:
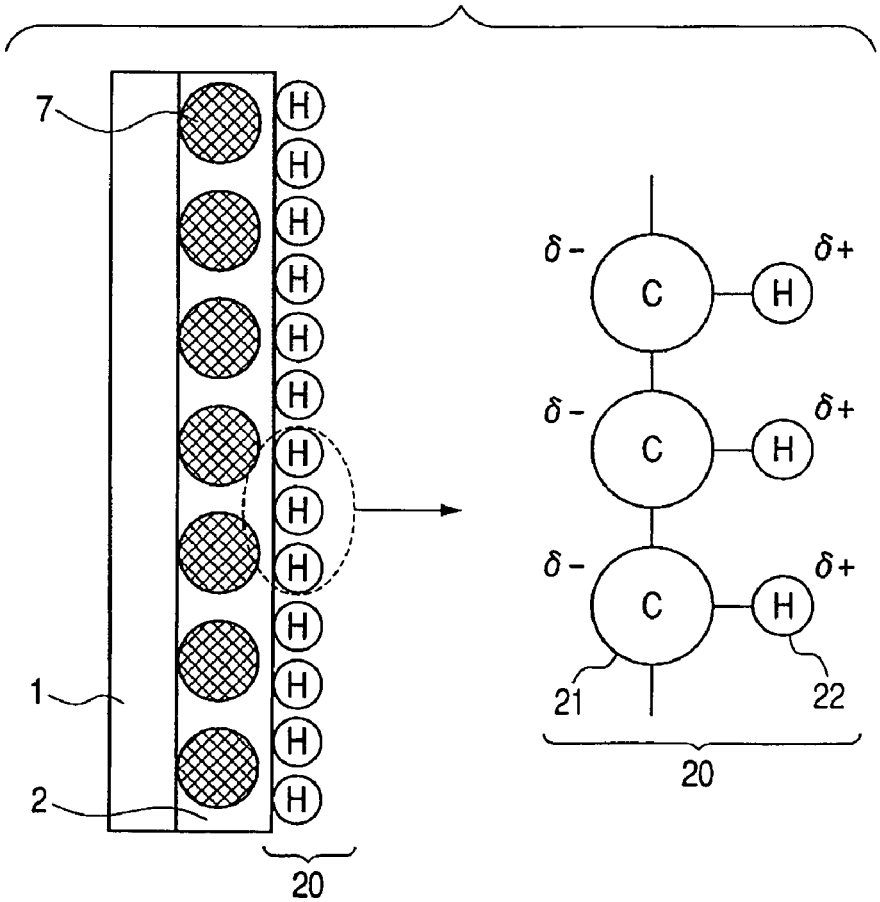
FIG. 2 is a magnified partial schematic view of an electron emitting device of the present invention.

Now reference is made to FIG. 2 for explaining the state shown in FIG. 1A, in consideration of the basic configuration of the electron-emitting device of the present invention. FIG. 2 shows a state where plural electroconductive particles 7 are provided in electrical contact with the cathode electrode 1. In FIGS. 1A and 1B, the plural electroconductive particles 7 are omitted for the purpose of simplicity. In FIG. 2, there are shown a cathode electrode 1, electroconductive particles 7, a dipole layer 20, carbon atoms 21 and hydrogen atoms 22. The electroconductive particles 7 are electrically connected with the cathode electrode 1. Therefore, in the energy band diagram shown in FIG. 1A, a member represented by a symbol 1 can be considered substantially equivalent to the electrodconductive particles 7. There is now shown a case where each electroconductive particle 7 is in direct connection with the cathode electrode 1, but a resistance layer may be provided between the electroconductive particles 7 and the cathode electrode 1, as will be explained later. Also a direct contact between the electroconductive particles 7 and the cathode electrode 1 is not necessarily essential as long as an electrical contact can be formed.

Figure 19:
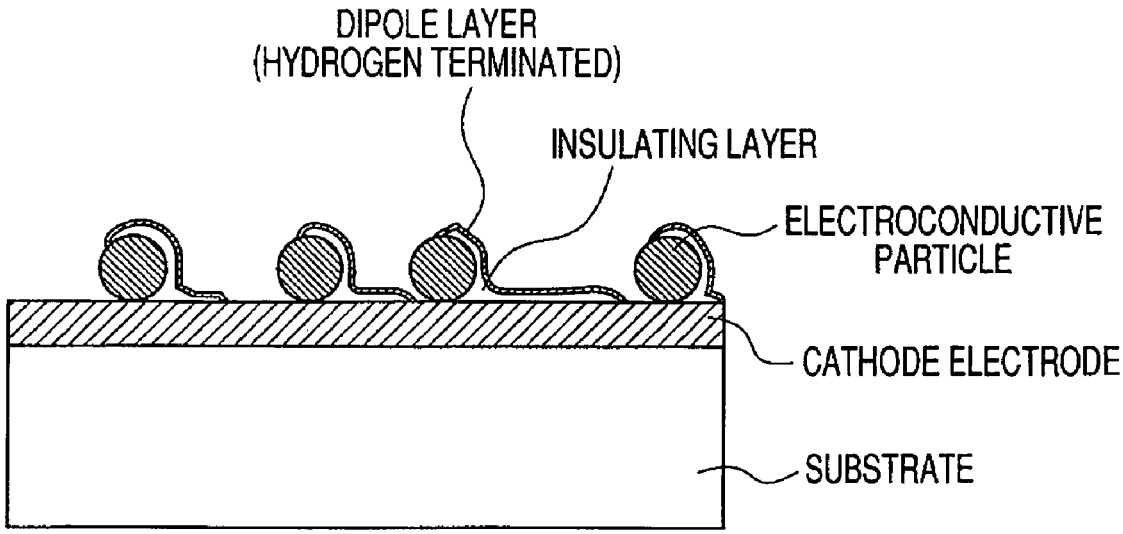
FIG. 19 is a partial cross sectional view of an electron emitting device that can be formed by the producing method for the electron emitting device of the present invention.
Figure 20:
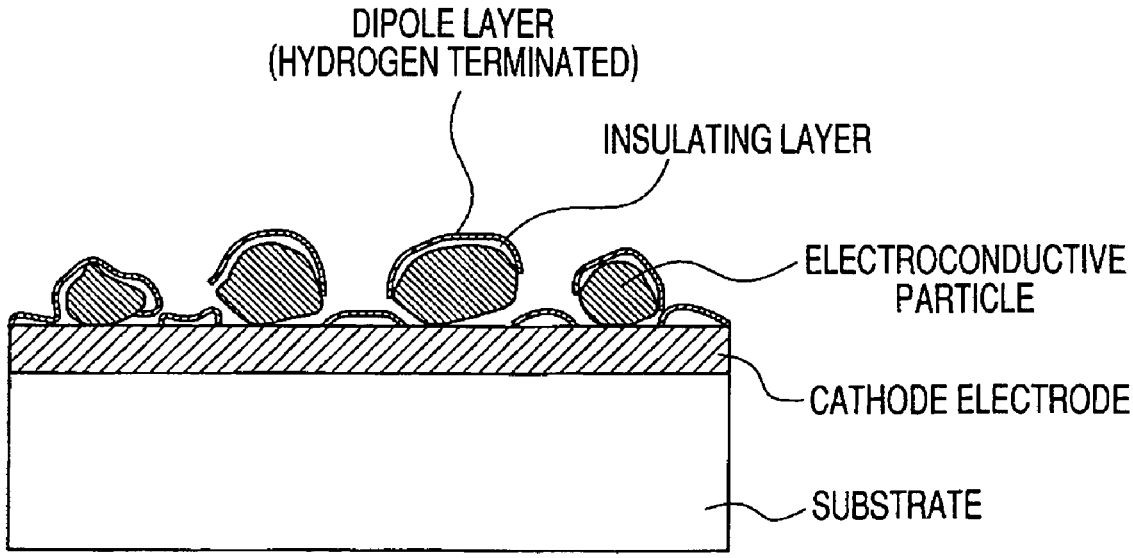
FIG. 20 is a partial cross sectional view of an electron emitting device that can be formed by the producing method for the electron emitting device of the present invention.

In FIG. 2, at least a part of a surface of the electroconductive particle 7 is covered with the insulation layer 2 of a thickness of 10 nm or less. In a state shown in FIG. 2, each electroconductive particle 7 is in a state completely covered by the insulation layer 2 (state where the electroconductive particle is embedded in the insulation layer 2). In such state, the insulation layer 2 on the electroconductive particle 7 has a thickness of 10 nm or less in a thinnest portion thereof. In the present invention, however, the covering of the electroconductive particle with the insulation layer is not limited to a state in which the electroconductive particle 7 is embedded in the insulation layer 2 as shown in FIG. 2. More specifically, as shown in FIGS. 19 and 20, each electroconductive particle is required to be covered, in at least a part thereof, with an insulation of a thickness of 10 nm or less. In the present invention, in an embodiment shown in FIG. 2 or more specifically in an embodiment shown in FIGS. 17A to 17D and FIG. 19 or FIG. 20, the electroconductive particles 7 and the insulation layer 2 may be collectively called "insulation layer containing electroconductive particles 7". The surface of the insulation layer 20 has a dipole layer 20. A portion with a spatial distance (thickness) of 10 nm or less between the electroconductive particles 7 and the dipole layer 20 can be construed to correspond to the insulation layer 2 shown in FIG. 1A.

Now there is shown a case where the dipole layer 20 is formed by terminating the surface (interface with vacuum space) of the insulation layer 2 with hydrogen atoms 22, but the dipole layer 20 in the present invention is not limited to such hydrogen termination. Also there is shown a case where the insulation layer 2 is formed by a carbon layer, but the material of the insulation layer is not limited to carbon. Nevertheless, a carbon layer is preferred in consideration of the electron emitting characteristics and the ease of preparation. Also the material for terminating the surface of the insulation layer 2 can be any material capable of reducing a surface energy level of the insulation layer 2 in a state where no voltage is applied between the cathode electrode 1 and the extracting electrode 3, but is preferably hydrogen. The material for terminating the surface of the insulation layer 2 is preferably a material capable of reducing the surface energy level of the insulation layer 2 by 0.5 eV or more, preferably 1 eV or more, in a state where no voltage is applied between the cathode electrode 1 and the extracting electrode 3.

However, in the electron-emitting device in which the present invention is applicable, the energy level of the surface of the insulation layer is required to show a positive electron affinity both in the presence and in the absence of a driving voltage application between the cathode electrode 1 and the extracting electrode 3.

Also a voltage applied to the anode electrode is generally within a range of 5 to 30 kV (preferably 10 to 25 kV). Consequently, an electric field formed between the anode electrode and the electron-emitting device is generally considered to have a strength of $1\times10^5$ V/cm or less. It is therefore preferred that the electrons are not emitted from the electron-emitting device under such field strength.

For this reason, the electron affinity of the surface of the insulation layer 2 bearing the dipole layer is practically 2.5 eV or higher in consideration of the thickness of the insulation layer 2, and preferably 3 eV or higher.

A thickness of the insulation layer 2 positioned between the electroconductive particles 7 and the dipole layer 20 may be determined according to the driving voltage, but is preferably selected as 10 nm or less in consideration of the aforementioned range (50 V or less) of the driving voltage. Also as to the thickness of the insulation layer 2 positioned between the electroconductive particles 7 and the dipole layer 20, a lower limit is for constituting a barrier (insulation layer 2 and vacuum barrier) to be tunneled by the electrons 6 supplied from the cathode electrode 1 in the driving state, but is preferably selected as 1 nm or larger in consideration of reproducibility of film formation.

Thus, in the electron-emitting device in which the present invention is applicable, the insulation layer 2 always exhibits a positive electron affinity thereby securing a high on/off ratio in the electron emission amount between a selected state and a non-selected state, that has been difficult to secure in the prior technology.

Also the energy band diagram shown in FIGS. 1A and 1B can be ideally realized, instead of utilizing the electroconductive particles 7 as shown in FIG. 2, by forming a uniform insulation layer 2 for example with a thickness of 10 nm on a cathode electrode 1 having an extremely flat surface. However, in order to secure a sufficiently high emission site density (ESD) and to reduce the fluctuation in the electron emission amount, it is required to form the insulation layer 2 with an extremely uniform thickness and to provide the cathode electrode 1 with an extremely flat surface. Preparation of such electron emitting device with a satisfactory reproducibility may involve a complication a severe management of the production process thereby resulting in an increased production cost.

On the other hand, by positioning a plurality of electroconductive particles 7 on the cathode electrode 1 in electrical contact therewith and by depositing, for example by an inclined evaporation, a material for constituting the insulation layer 2 onto such plural particles 7, it is possible to form an insulation layer 2 of a thickness of 10 nm or less on each electroconductive particle 7 in a self-aligned manner.

FIG. 2 shows an example where the dipole layer 20 is formed by a hydrogen termination of the surface of the insulation layer 2. In generally, a hydrogen atom is slightly polarized positively ($\delta^+$). Consequently an atom (carbon atom 21 in this case) on the surface of the insulation layer 2 is slightly polarized negatively ($\delta^-$), thereby constituting a dipole layer 20 (which may also be called "electrical double layer").

Therefore, in the electron-emitting device in which the present invention is applicable, even in a state where the driving voltage is not applied between the cathode electrode 1 and the extracting electrode 3 as shown in FIG. 1A, the surface of the insulation layer 2 shows a state equivalent to the application of the potential $\delta$ [V] of the electrical double layer. Also under the application of the driving voltage V [V], the surface energy level of the insulation layer 2 is lowered as shown in FIG. 1B and the vacuum barrier 4 is also lowered in linkage. In the present invention, the thickness of the insulation layer 2 is so suitably selected that the electrons can tunnel through the insulation layer 2 under the driving voltage V [V], and, in consideration of the burden of a driving circuit, at 10 nm or less as described before. With a film thickness of 10 nm or less and under the application of the driving voltage V [V], the spatial distance through the insulation layer 2 can be sufficiently reduced for the electrons 6 supplied from the cathode electrode 1, whereby the tunneling is rendered possible.

As a result of the application of the driving voltage V [V], the vacuum barrier 4 is also lowered as described before and the spatial distance thereof is also reduced as in the insulation layer 2, whereby the tunneling is made possible and the electron emission to the vacuum space is realized.

In the electron-emitting device in which the present invention is applicable, the electron 6 is considered to tunnel through the insulation layer 2 on the electroconductive particle 7, so that the electron emission sites are present in discrete manner.

As the fluctuation in the electron-emitting device can be generally lowered by a larger number of the electron emission sites, it is desirable to increase the emission site density as high as possible. The electron emission site density, required in the electron-emitting device in which the present invention is applicable, is at least $10^4/mm^2$ in consideration of an application to a display such as a television, preferably $10^6/mm^2$ or more.

In the electron-emitting device in which the present invention is applicable, as the electroconductive particles 7 constitute latent electron emission sites, a number of the electroconductive particles 7 is at least $10^4/mm^2$, preferably $10^6/mm^2$ or more. Also a number of the electroconductive particles 7 covered with the insulation layer 2 of a thickness of 10 nm or less is at least $10^4/mm^2$, preferably $10^6/mm^2$ or more.

The electron-emitting device in which the present invention is applicable may assume various configurations, of which examples are shown in FIGS. 3 to 6, wherein shown are a substrate 31, a gate electrode 32 functioning as an extraction electrode for extracting electrons from the cathode electrode 1, and an anode electrode 33.

In examples shown in FIGS. 3 to 6, the gate electrode and the cathode electrode 1 are provided with a space therebetween on the substrate 31. An anode electrode 33 is so positioned as to be opposed to the substrate 31 bearing the cathode electrode 1 to constitute so-called 3-terminal electron emitting device (or triode structure). In FIGS. 3 to 6, for the purpose of simplicity, only an insulation layer 2 (and dipole layer 20) is illustrated on the surface of the cathode electrode 1. In fact, however, plural electroconductive particles 7 (not shown) and an insulation layer 2 covering at least a part of each surface of such plural electroconductive particles 7 with a thickness of 10 nm or less are provided on the surface of the cathode electrode 1, as shown in FIGS. 2, 17A to 17D, 19 or 20. Then a dipole layer 20 is formed on the surface of the insulation layer 2 covering the surface of the electroconductive particles 7 with a thickness of 10 nm or less.

In FIGS. 3 to 6, Vg indicates a voltage applied between the gate electrode 32 and the cathode electrode 1. At an electron emission, the cathode electrode 1 is set at a potential lower than that of the gate electrode 32. Also Va indicates a voltage applied between the cathode electrode 1 and the anode electrode 33. The voltage Va is preferably applied constantly to the anode electrode 33 during an operated state of the electron-emitting device.

In the configurations shown in FIGS. 3 to 6, Vg [V] and Va [V] are applied in order to drive the electron-emitting device, a strong electric field is applied to the insulation layer 2 containing the electroconductive particles 7, on the cathode electrode 1. A shape of an equipotential surface is determined by Vg [V], a thickness and a shape of the insulation layer 2 and a dielectric constant thereof.

Electrons are emitted from the cathode electrode 1 when the electric field, applied to the insulation layer containing the electroconductive particles 7 (also called "electron emitting film"), exceeds a certain threshold value. The emitted electrons are accelerated toward the anode electrode 33. By providing the anode electrode 33 with a light-emitting member capable of light emission by the electron collision, such as a phosphor (not shown), light is emitted from such light-emitting member.

Figure 3:
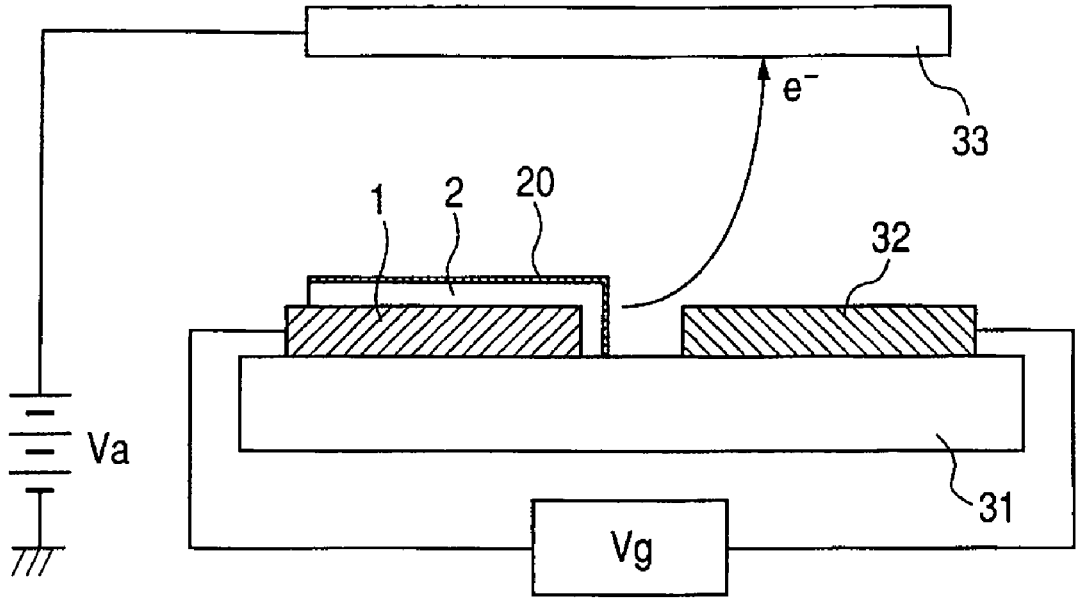
FIG. 3 is a schematic cross-sectional view showing a configuration of an electron emitting device of the present invention.
Figure 4:
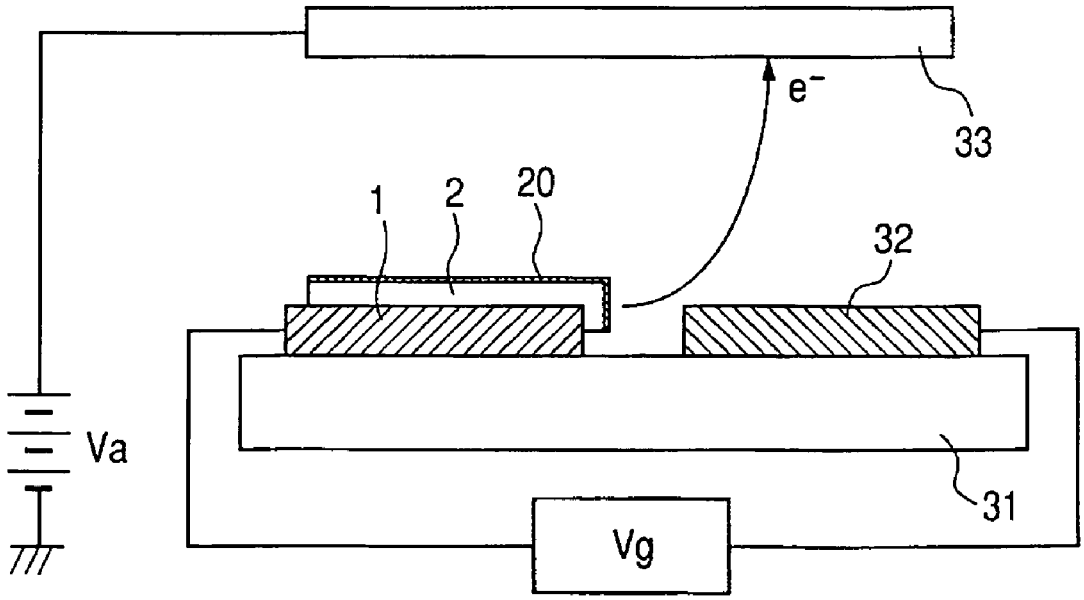
FIG. 4 is a schematic cross-sectional view showing a configuration of an electron emitting device of the present invention.
Figure 5:
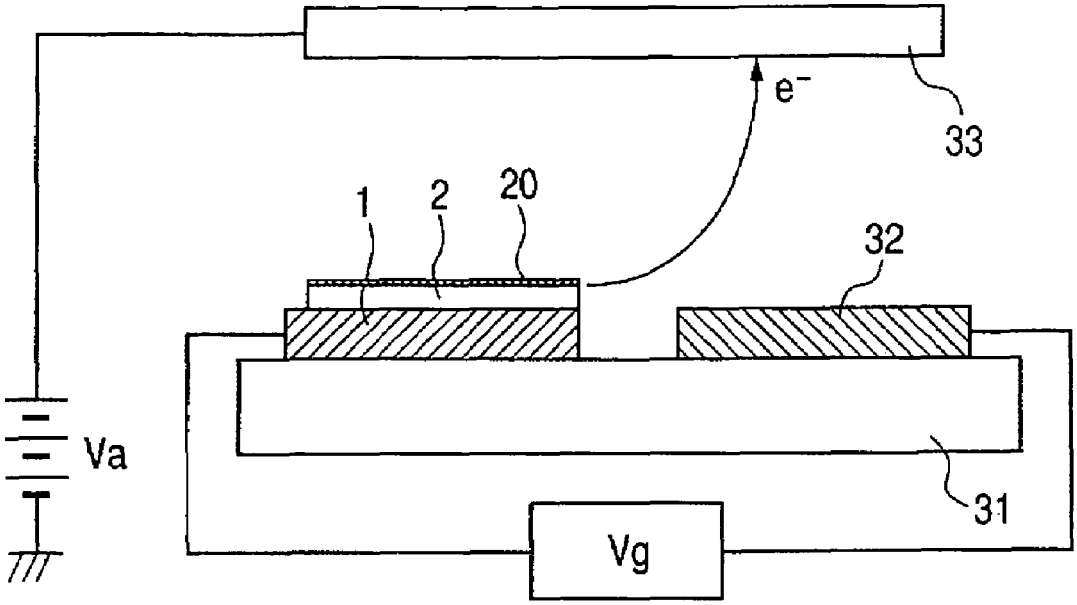
FIG. 5 is a schematic cross-sectional view showing a configuration of an electron emitting device of the present invention.
Figure 6:
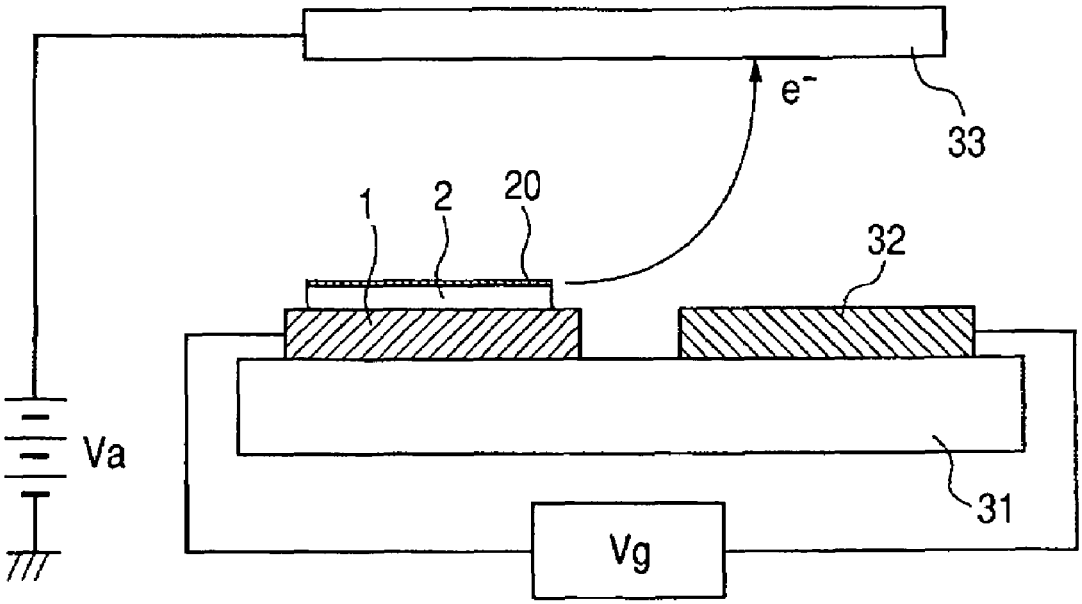
FIG. 6 is a schematic cross-sectional view showing a configuration of an electron emitting device of the present invention.

FIG. 3 shows a configuration in which the aforementioned insulation layer 2 containing the electroconductive particles 7 covers the substantially entire surface of the cathode electrode 1 and the dipole layer 20 is formed thereon. FIG. 4 shows a configuration in which the insulation layer 2 containing the electroconductive particles 7 is not in contact with the substrate 31 at an end portion (side surface) of the cathode electrode 1 opposed to the gate electrode 32, thereby exposing a lower part of the cathode electrode 1. FIG. 5 shows a configuration in which the insulation layer 2 containing the electroconductive particles 7 is provided only an upper surface of the cathode electrode 1 (surface opposed to the anode electrode 33 or substantially parallel to the substrate 1). Also FIG. 6 shows a configuration in which an end portion of the insulation layer 2 containing the electroconductive particles 7 as shown in FIG. 5 is retracted from an end portion (edge) of the cathode electrode 1 opposed to the gate electrode 32 thereby exposing an edge of the cathode electrode 1. Electron emission efficiencies (a proportion of electrons arriving at the anode electrode 33 to all the electrons emitted from the cathode electrode 1) in these configurations are in a relation: FIG. 3<FIG. 4<FIG. 5<FIG. 6. Also the configuration shown in FIG. 6 is particularly preferable as a uniformity of the strength of the electric field applied to the insulation layer 2 containing the electroconductive particles 7 therein is better than that in the configurations shown in FIGS. 3 to 5, so that it is superior in a uniformity of the emission current distribution to the configurations shown in FIGS. 3 to 5.

The foregoing configurations show a 3-terminal structure (triode structure), but so-called 2-terminal structure (diode structure) can also be realized by omitting the gate electrode 32 in the configurations shown in FIGS. 3 to 5. In such case, the anode electrode serves as an extracting electrode. Also FIGS. 3 to 6 show a structure in which the gate electrode 32 and the cathode electrode 1 are positioned on a same substrate, but it is also possible, as in so-called Spindt type structure, to adopt a structure in which the gate electrode 32 is positioned between the cathode electrode 1 and the anode electrode 33 and above the cathode electrode 1. In such configuration, the gate electrode 32 is provided with an aperture (so-called "gate hole") for passing the electrons emitted from the cathode electrode 1. In case of employing a gate electrode having such aperture, there can be adopted a following configuration, in which the cathode electrode 1 is provided thereon with an insulation layer having an aperture for exposing at least a part of the cathode electrode (at least a part of the insulation layer 2 containing the electroconductive particles 7), and a gate electrode having an aperture is positioned above the insulation layer in such a manner that the aperture communicates with the aperture in the insulation layer.

Also in a 3-terminal structure shown in FIGS. 3 to 6, it is possible to cause an electron emission from the cathode electrode 1 by a complex electric field formed by both the gate electrode 32 and the anode electrode 33. In such case, the gate electrode 32 and the anode electrode 33 serve as the extracting electrode. The electron-emitting device of the present invention can emit electrons by an application of a low electric field less than $1\times10^6$ V/cm between the surface of the insulation layer 2 and the extracting electrode (practically regarded as "between the cathode electrode 1 and the extracting electrode" because the insulation layer 2 is very thin).

In the electron emitting device in which the present invention is applicable, the surface of the cathode electrode 1 is preferably flat, but may have certain irregularities. Also the outermost surface of the insulation layer 2 containing the electroconductive particles 7 may be flat or may have irregularities not exceeding the diameter of the electroconductive particles 7. However a flat outermost surface of the insulation layer 2 can suppress the divergence of the emitted electrons. For this reason, each of the plural electroconductive particles 7 is preferably embedded completely in the insulation layer, and, in practicum, the outermost surface of the insulation layer has a surface roughness preferably smaller than an average particle size of the electroconductive particles 7 for attaining the converging of the electron beam.

Figure 7A:
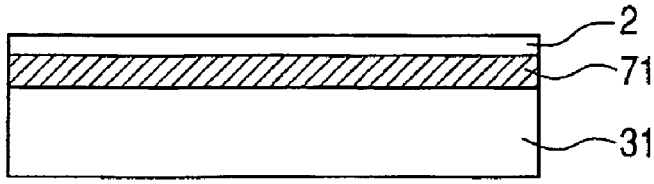
FIGS. 7A, 7B, 7C, 7D and 7E are schematic cross-sectional views showing a producing method for the electron emitting device of the present invention.
Figure 7B:
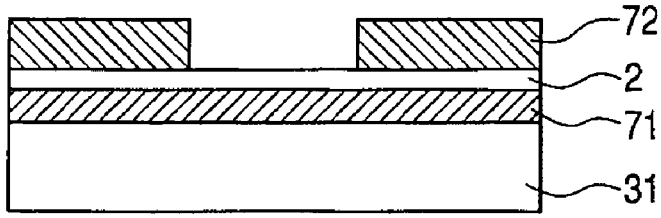
Figure 7C:
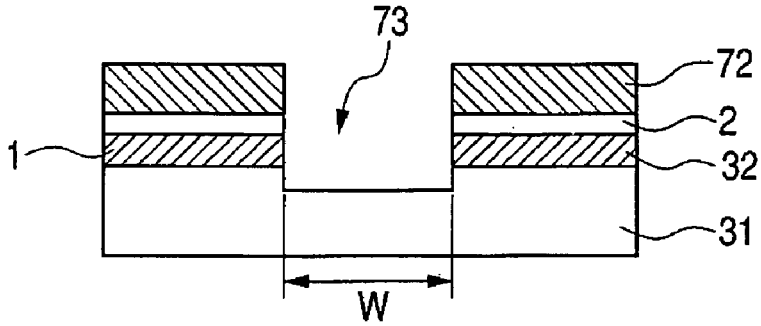
Figure 7D:
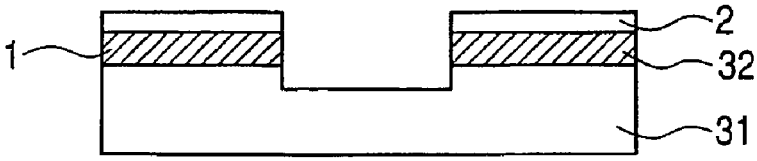
Figure 7E:
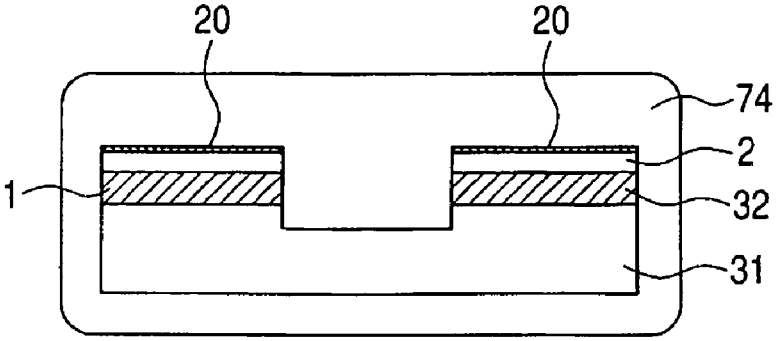

In the following, a producing method for the above-described electron emitting device will be explained with reference to FIGS. 7A to 7E, in which, for the purpose of simplicity, only an insulation layer 2 (and dipole layer 20) is illustrated on the surface of the cathode electrode 1 (FIG. 7E). In fact, however, plural electroconductive particles 7 (not shown) and an insulation layer 2 covering at least a part of each surface of such plural electroconductive particles 7 with a thickness of 10 nm or less are provided on the surface of the cathode electrode 1, as shown in FIGS. 2, 17A to 17D, 19 or 20. Then a dipole layer 20 is formed on the surface of the insulation layer 2 covering the surface of the electroconductive particles 7 with a thickness of 10 nm or less.

(Step 1)

An insulating substrate, such as quartz glass, glass with lowered impurity such as Na, soda lime glass, a laminate member having oxide silicon (such as silica) deposited on a base surface, or a ceramic, with sufficiently washed surface is employed as a substrate 31, on which an electrode layer 71 is deposited.

The electrode layer 71 generally has an electroconductivity, and is form by an ordinary film forming technology such as evaporation or sputtering. A material of the electrode layer 71 is selected from a metal or an alloy, and such metal can for example be Be, Mg, Ti, Zr, Hf, V, Nb, Ta, Mo, W, Al, Cu, Ni, Cr, Au, Pt or Pd. A thickness of the electrode layer 71 is selected within a range of 10 nm to 100 μm, preferably 100 nm to 10 μm.

(Step 2)

As shown in FIG. 7A, an insulation layer 2 containing electroconductive particles 7 is formed on the electrode layer 71.

A step of forming the insulation layer 2 containing the electroconductive particles 7 may be conducted by:

(step 2-A): method of separately forming the electroconductive particles 7 and the insulation layer 2;

(step 2-B): method of providing the electroconductive particles 7 in the insulation layer 2; or (step 2-C): method of simultaneously forming the electroconductive particles 7 and the insulation layer 2.

A material for the electroconductive particles 7 may be same as or different from the material constituting the electrode layer 71. The material of the electroconductive particle 7 is selected from a metal or an alloy, and such metal can for example be Be, Mg, Ti, Zr, Hf, V, Nb, Ta, Mo, W, Al, Cu, Fe, Co, Ni, Cr, Au, Pt or Pd.

A shape of the electroconductive particles 7 may be spherical or otherwise. There can also be employed a polygon-like shape as shown in FIG. 20. The electroconductive particles 7 to be employed are selected with an average particle size (average diameter) within a range of 1 nm to 1 μm, preferably 3 to 100 nm. The average particle size is an average of a maximum length in a cross section of each particle.

The insulation layer 2 may cover the entire electroconductive particle 7, but at least covers a part thereof. The insulation layer 2 covering the electroconductive particle 7 has such a thickness that the electron can execute a tunneling. More specifically, it includes a portion with a thickness of 10 nm or less on the electroconductive particle 7 as explained before, and preferably includes a portion of a thickness of 1 nm or more to 10 nm or less on the electron emitting device 7.

The insulation layer 2 may be basically formed by any material, but, in consideration of concentration of electric field, preferably a material with a smaller (lower) dielectric constant. The material for the insulation layer 2 preferably has a resistivity in a practical range of $1\times10^8$ Ωcm or higher, and more preferably $1\times10^{14}$ Ωcm or less. As a specific material, carbon can be employed advantageously. It is however important, as explained above, that the insulation layer 2 has a high resistance and substantially functions as an insulating member. For this reason, for example diamond-like carbon (DLC), amorphous carbon, a metal nitride, a metal oxide or a metal carbide may be employed as a principal component of the insulation layer 2. In case of employing carbon as the material for the insulation layer 2, a carbon film containing $sp^3$ bond or a carbon film containing hydrogen bond is preferred as it improves the insulating property of the insulation layer 2. Particularly $sp^3$ carbon is preferably employed as the principal component. However crystalline diamond containing $sp^3$ bond (typically monocrystalline diamond) may include a crystalline plane showing NEA, and a carbon film formed by such crystalline diamond showing NEA property is undesirable for the insulation layer 2. It is therefore preferable, in case of employing diamond for the insulation layer 2, to utilize a carbon film having an amorphous character, such as a diamond-like carbon film or an amorphous carbon film, which m having an of positive electron affinity during a driving period of the electron-emitting device in the present invention.

The above carbon film (insulating film 2) has desirably Raman scattering intensity distribution characteristics observed by irradiation with a laser of wave-length 514.5 nm such that a Raman shift has a first peak of the Raman scattering formed within a range 1350±20 $cm^{-1}$. And, simultaneously, the Raman shift has a second peak of the Raman scattering formed within a range 1600±20 $cm^{-1}$. Further, the carbon film (insulating film 2) has desirably thickness in a range substantially 15-200 nm. And, the above described metal particle is contained in the carbon film desirably at a density 5-30 atm %. As the metal particle contained in the carbon film, Pt, Co or Ni particle of an average diameter 3-30 nm would be desirably used. And, for the purpose of providing an electron-emitting device of an excellent electron emitting performance (high electron emission current) it would be desirable to provide the carbon film containing the metal particle with a dipole layer described below at a surface of the carbon film.

In the method of the aforementioned (step 2-A), there can be adopted a method of placing plural electroconductive particles 7 on the electrode layer 71 and forming the insulation layer 2 thereon. The method of (step 2-A) can be realized for example by a following procedure.

(step 2-A-1)

At first, on the electrode layer 71, electroconductive particles 7 are formed by ordinary evaporation or sputtering. It is also possible to form a material to constitute the electroconductive particles 7 into a film and then to granularize such film. The granularization can be achieved, for example, by subjecting a film of the material to constitute the electroconductive particles 7 to an annealing or a plasma irradiation.

(step 2-A-2)

Then the insulation layer 2 is formed for example by evaporation, sputtering, plasma CVD or HF-CVD (hot filament-CVD). Also an inclined evaporation may be utilized to positively form a film thickness distribution in the insulation layer 2 on the electroconductive particles 7. Such formation of the insulation layer allows, utilizing the shape of the electroconductive particles 7, to provide the insulation film deposited thereon with a film thickness distribution. As a result, an insulation layer of a thickness of 100 nm or less in self-aligned manner on the surface of the electroconductive particles 7.

Also in the aforementioned method of (step 2-B), there may be employed a method of implanting metal ions into an insulation layer prepared in advance, and heating the particles together with the insulation layer thereby adsorbing the implanted metal ions by the particles 7.

Also in the aforementioned method of (step 2-C), there may be employed a method of dispersing electroconductive particle 7 in a solution containing a material for constituting the insulation layer 2 thereby obtaining a dispersion of the electroconductive particles 7, and coating and drying (baking) such dispersion.

The dispersion can be coated by various printing methods (screen printing, offset printing, or flexographic printing), spin coating, dip coating, spray coating, stamping, roll coating, slit coating or ink jet printing.

Another method belonging to (step 2-C) is to form a resin layer as a precursor of the insulation layer, then to contact such resin layer with a liquid containing a material for constituting the electrdconductive particles 7 (typically a metal solution) thereby causing the resin layer to absorb such material, and to dry (bake) the resin layer.

The resin layer is preferably a photosensitive resin layer, which may be formed by a type including a photosensitive group within the resin structure or a type formed by mixing a photosensitizer with the resin. Also for causing the resin layer to contain (absorb) the material for constituting the electroconductive particles 7, the resin layer is preferably formed by a resin capable of ion exchange. Also the liquid containing the material for constituting the electroconductive particles 7 is preferably a solution of an ion exchangeable metal. It is particularly preferably absolution of a metal complex compound.

For causing the material for constituting the electroconductive particles 7 to be contained (absorbed or impregnated) in the resin, there can be employed a method of dipping the resin layer in a solution containing the material for constituting the electroconductive particles 7 (dipping method), or a method of depositing a solution containing the material for constituting the electroconductive particles 7 onto the resin layer (spray method or spin coating method).

After the inclusion of the material for constituting the electroconductive particles 7, the resin layer is baked to decompose an organic component in the resin, whereby the resin becomes inorganic (carbonization (change to amorphous carbon)) to form the insulation layer 2 and the material, contained in the resin layer, for constituting the electroconductive particles 7 is converted into particles.

For controlling the thickness of the resin layer 2, covering the electroconductive particle 7, to 10 nm or less, there may be employed a method of controlling a film forming condition (for example deposition rate) of the insulation layer, a method of etching the insulation layer 2, after formation thereof, to a desired thickness, a method of controlling a concentration of the material for constituting the electroconductive particles contained in the insulation layer, or a method of controlling a particle size of the electroconductive particles contained in the insulation layer.

(Step 3)

A photoresist 72 is patterned in order to separate the electrode layer 71 into a cathode electrode 1 and a gate electrode 32 (FIG. 7B).

(Step 4)

An etching process is executed to separate, as shown in FIG. 7C, the electrode layer 71 into two electrodes (gate electrode 32 and cathode electrode 1). In the etching of the electrode layer 71 and the insulation layer 2, there is preferably formed a smooth and vertical, or smooth and tapered etching face. The etching method may be suitably selected according to the material, and may be a dry etching or a wet etching. A width W of an aperture (recess) 73 is suitably selected according to a material constituting the electron emitting device, a resistance thereof, a work function thereof, a driving voltage of the electron emitting device and a required shape of an emitted electron beam. Also a gap W between the gate electrode 32 and the cathode electrode 1 is preferably selected within a range of 100 nm to 100 μm.

A surface of the substrate 31 exposed between the cathode electrode 1 and the gate electrode 32 is preferably recessed as shown in FIG. 7C. Such recessed surface of the substrate 1 between the cathode electrode 1 and the gate electrode 32 allows to effectively elongate the creepage distance between the cathode electrode 1 and the gate electrode 32 in the operation of the electron emitting device and to reduce a leak current between the cathode electrode 1 and the gate electrode 32.

(Step 5)

The resist 72 is removed as shown in FIG. 7D.

(Step 6)

Finally, a dipole layer 20 is formed on the surface of the insulation layer 2.

The dipole layer 20 can be formed for example by a hydrogen termination of the surface of the insulation layer 2. FIG. 7E shows, as an example, of executing heating in an atmosphere 74 containing hydrogen and hydrocarbon gas. The hydrocarbon gas is preferably a linear hydrocarbon such as acetylene gas, ethylene gas or methane gas.

The embodiment explained above shows a case of forming the insulation layer 2 having the dipole layer 20 on the surface of both the cathode electrode 1 and the gate electrode 32, but the insulation layer 2 having the dipole layer 20 is preferably formed only on the cathode electrode 1.

Figure 15A:
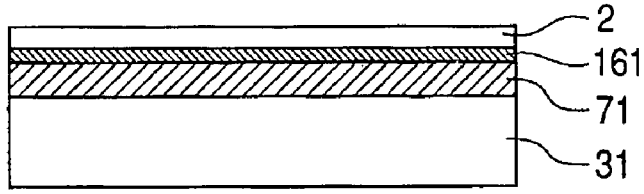
FIGS. 15A, 15B, 15C, 15D and 15E are schematic cross sectional views showing a producing method for the electron emitting device of the present invention.
Figure 15B:
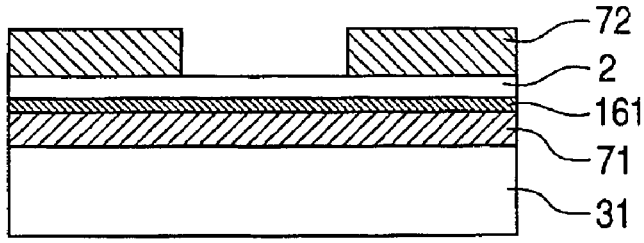
Figure 15C:
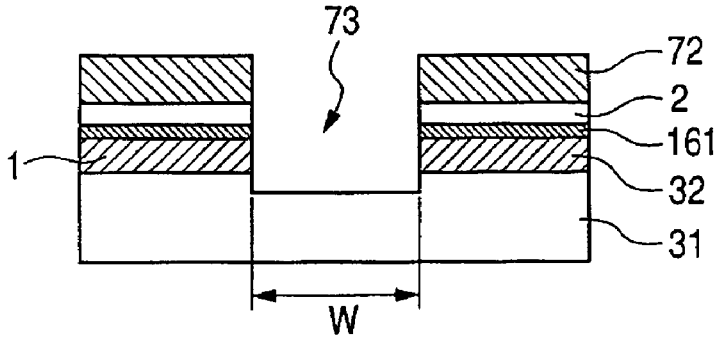
Figure 15D:
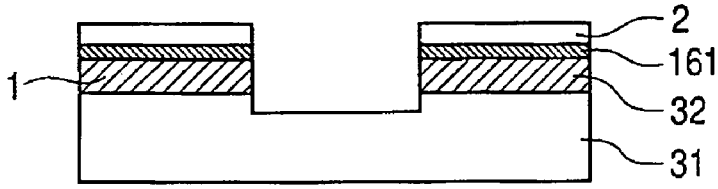
Figure 15E:
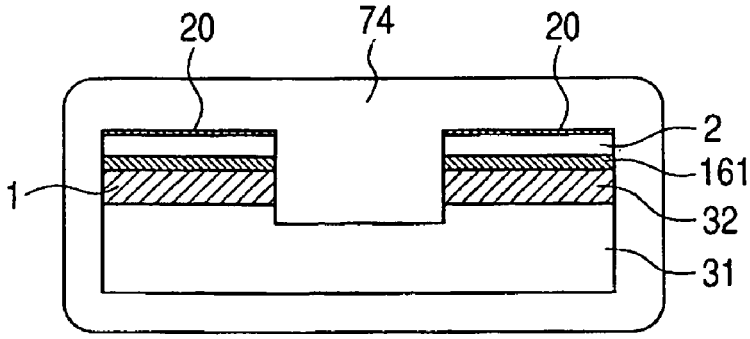
Figure 16A:
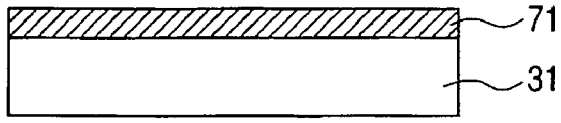
FIGS. 16A, 16B, 16C, 16D, 16E, 16F, 16G and 16H are schematic cross sectional views showing a producing method for the electron emitting device of the present invention.
Figure 16B:
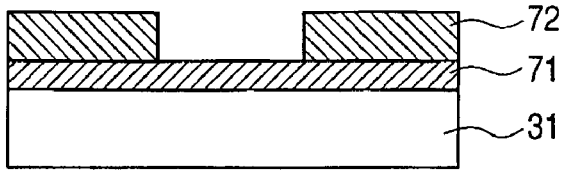
Figure 16C:
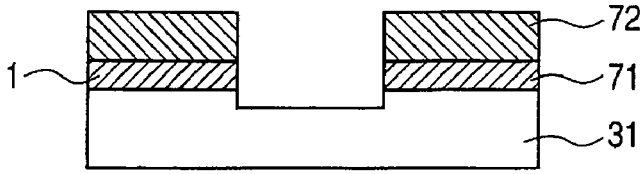
Figure 16D:
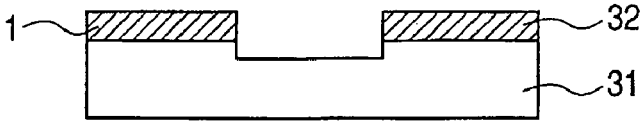
Figure 16E:
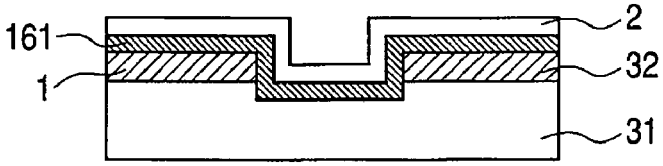
Figure 16F:
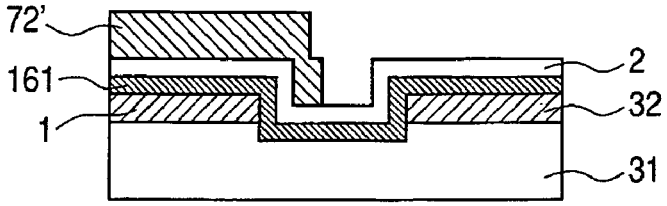
Figure 16G:
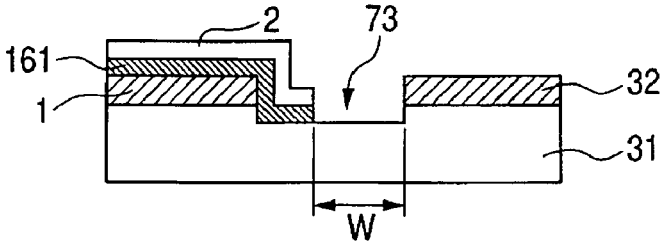
Figure 16H:
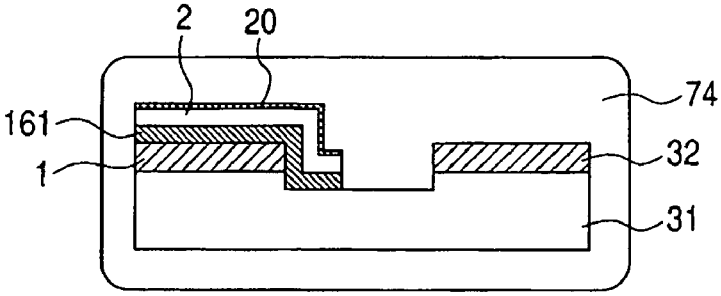

In the electron emitting device in which the present invention is applicable, a resistance layer 161 may be provided between the cathode electrode 1 and the insulation layer 2 as shown in FIG. 15E or 16H. The addition of such resistance layer 161 provides an effect of alleviating a change in time of the emission current at the electron emission. A detailed process of preparation will be explained in an example to be explained later.

The resistance layer 161 has a thickness of 10 nm to 1 μm, preferably 10 to 500 nm. The resistance layer 161 within such thickness range has a resistance selected within a range of $1\times10^5$ to $1\times10^8$ Ω, practically within a range of $1\times10^6$ to $1\times10^7$ Ω. The resistance layer may be formed by DLC (diamond-like carbon), amorphous carbon or doped amorphous silicon, but the present invention is not limited to such materials.

In the following there will be explained applications of the electron emitting device in which the present invention is applicable. For example an electron source, or an image display apparatus can be constructed by arraying a plurality of the electron emitting devices of the present invention on a substrate.

The electron emitting devices may be arranged in various arrays. As an example, there may be adopted so-called matrix arrangement, in which plural electron emitting devices are arranged in a matrix along X- and Y-directions, and either of the cathode electrodes and the anodes constituting the plural electron emitting devices arranged in a same row are commonly connected to a wiring in the X-direction, while the other of the cathodes and the anodes constituting the plural electron emitting devices arranged in a same column are commonly connected to a wiring in the Y-direction.

Figure 8:
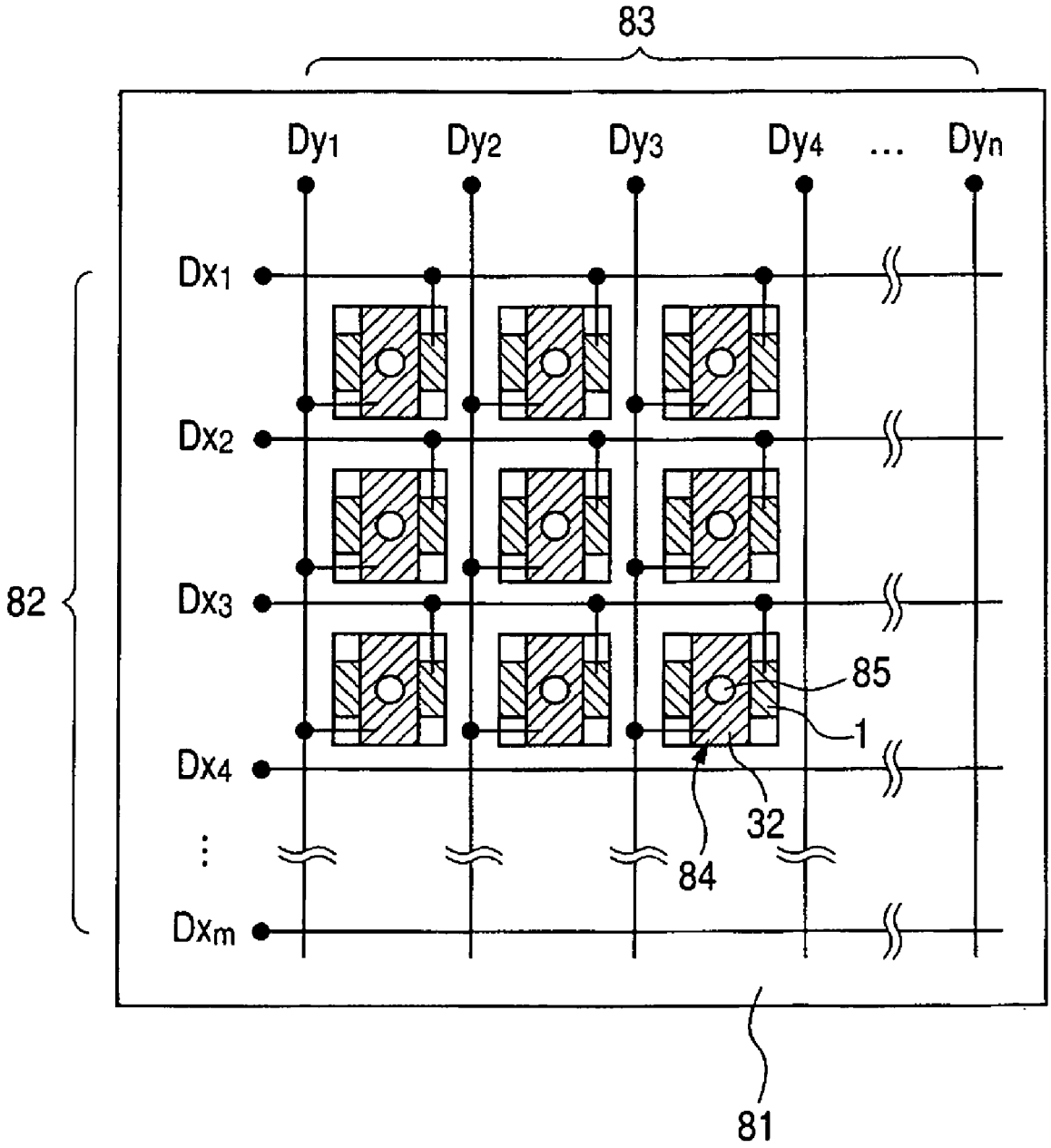
FIG. 8 is a schematic view showing a configuration of an electron source of the present invention.

In the following, an electron source of a matrix arrangement, obtained by arranging a plurality of the electron emitting devices of the present invention, will be explained with reference to FIG. 8, wherein shown are a substrate 81 of the electron source, an X-direction wiring 82, a Y-direction wiring 83, an electron emitting device 84 of the present invention, and an aperture 85. The electron emitting device of the present invention employed herein has a configuration in which a gate electrode 32 having an aperture 85 is positioned on a cathode electrode 1 having an electron emitting film.

X-direction wirings 82 Dx1, Dx2, . . . Dxm of a number m may be constituted for example of a conductive metal formed by vacuum evaporation, printing or sputtering. A material, a thickness and a width of the wiring can be suitably designed. Y-direction wirings 83 Dy1, Dy2, . . . Dyn of a number n are formed similarly to the X-direction wirings 82. Between such m X-direction wirings 82 and n Y-direction wirings 83, an unillustrated interlayer insulation layer is provided to electrically separate the both (m, n being positive integers).

The unillustrated interlayer insulation layer is constituted for example of $SiO_2$ formed by vacuum evaporation, printing or sputtering. Respective ends of the X-direction wirings 82 and the Y-direction wirings 83 are used as connection terminals to an external circuit.

Electrodes (cathode electrode 1 and gate electrode 32) constituting each electron emitting device are electrically connected to one of m X-direction wirings 82 and one of n Y-direction wirings 83.

A material constituting the X-direction wirings 82 and the Y-direction wirings 83 and a material constituting the cathode electrode 1 and the gate electrode 32 may be same in all the constituent elements or in a part thereof, or may be mutually different. In case the material constituting the cathode electrode 1 and the gate electrode 32 is same as that of the wirings, the wirings 82 and 83 may be considered respectively as the cathode electrode 1 or the gate electrode 32.

The X-direction wirings 82 are connected to unillustrated scanning signal application means which applies a scanning signal to a selected X-direction wiring connecting a selected electron-emitting devices 84 arranged in the X-direction. On the other hand, the Y-direction wirings 83 are connected to unillustrated modulation signal application means which applies a modulation signal, in sync with the application of the scaning signal to the selected X-direction wiring, to a Y-direction wiring connecting a selected electron-emitting device 84 arranged in the Y-direction. A drive voltage applied to each electron emitting device is supplied as a difference of the scanning signal and the modulation signal applied to the selected device. Now there is shown a case of applying the scanning signal to the gate electrode 32 and the modulation signal to the cathode electrode 1, but it is also possible to apply the modulation signal to the gate electrode 32 and the scanning signal to the cathode electrode 1.

The above-described configuration can select each device and drive it independently by a simple matrix wiring. Now an image display apparatus constructed with an electron source of such simple matrix wiring will be explained with reference to FIG. 9, which is a schematic view showing an example of a display panel of the image display apparatus. Components represented by symbols in FIG. 9, same as those in FIG. 8, represent same components explained in FIG. 8.

Figure 9:
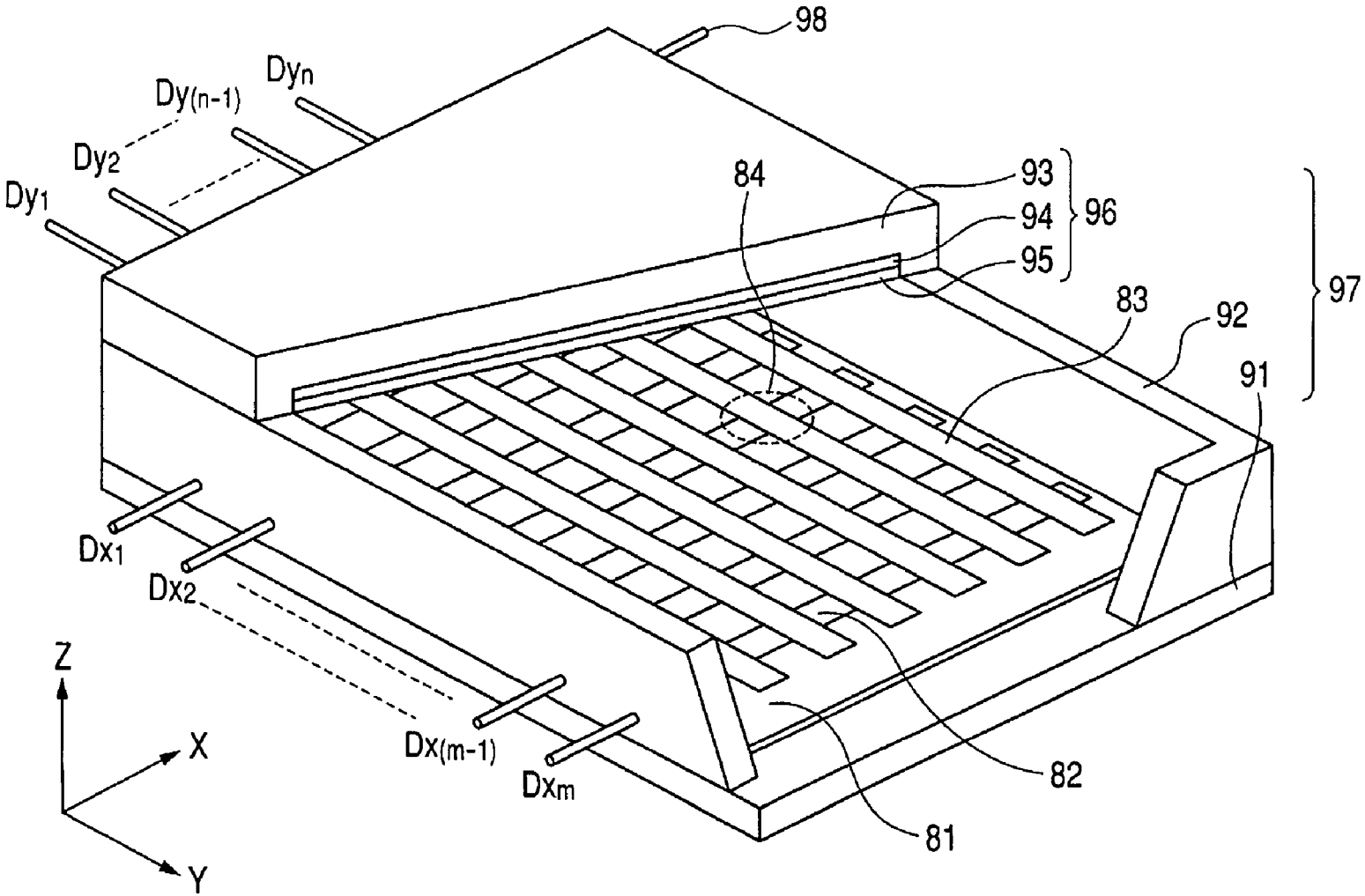
FIG. 9 is a schematic view showing a configuration of an image display apparatus of the present invention.

In FIG. 9, there are shown a substrate 81 of an electron source including plural electron emitting devices 84 of the present invention, a rear plate 91 supporting the electron source substrate 81, a face plate 96 bearing an image forming member constituted of a phosphor film 94 and a metal back 95 on an internal surface of a transparent substrate 93 such as of glass, a supporting frame 92 connected with the rear plate 91 and the face plate 96 for example with frit glass, and an envelope (panel) 97.

The envelope (container) 97 is constituted of the face plate 96, the supporting frame 92 and the rear plate 91 as explained above. The rear plate 91 is principally provided for reinforcing the strength of the substrate 91, and may be dispensed with in case the substrate 91 itself has a sufficient strength. It is thus possible to directly bond the supporting frame 91 to the substrate 91 and to constitute the envelope 97 by the face plate 96, the supporting frame 92 and the substrate 81. On the other hand, an unillustrated support member called spacer may be provided between the face plate 96 and the rear plate 91 to constitute an envelope 97 having a sufficient strength to the atmospheric pressure.

Then the envelope 97 subjected to the bonding step is sealed off. The sealing step is executed by evacuating the interior of the envelope 97 by an evacuating apparatus through an exhaust pipe (not shown) and then sealing off the exhaust pipe. In order to maintain the pressure in the envelope 97 after the sealing, a getter process may be executed. The getter may be an evaporation type such as Ba or a non-evaporation type. In the foregoing there is shown a method of sealing off the exhaust pipe after the bonding, but by executing the bonding step in a vacuum chamber, the sealing step becomes unnecessary after the bonding and the exhaust pipe itself becomes unnecessary.

In the image display apparatus constructed with the electron source of matrix arrangement produced through the aforementioned steps, an electron emission can be caused from a desired electron emitting device by applying voltages through the external terminals Dx1-Dxm and Dy1-Dyn. Also a high voltage Va (preferably 10 to 25 kV) is applied to the metal back 95 or a transparent electrode (not shown) through a high voltage terminal 98, thereby accelerating the electron beam. The accelerated electrons collide with the phosphor film 94 to emit light, thereby displaying an image.

Also an information display/reproduction apparatus can be constructed utilizing the display panel (image display apparatus) 97 of the present invention explained in FIG. 9.

The information display/reproduction apparatus is provided with a reception apparatus for receiving a broadcast signal such as a television signal and a tuner for selecting the received signal, and outputs at least of image information, character information and audio information contained in the selected signal to the display panel thereby causing it to be displayed and/or reproduced on the screen of the display panel. Such configuration allows to construct an information display/reproduction apparatus such as a television apparatus. In case the broadcast signal is encoded, the information display/reproduction apparatus of the present invention may include a decoder. Also the audio signal is outputted to audio reproduction means such as a speaker and reproduced in synchronization with the image information or the character information displayed on the display panel.

The configuration of the information display/reproduction apparatus described above is merely an example and is subject to various modifications based on the technical concept of the present invention. Also the information display/reproduction apparatus of the present invention may be connected with a television conference system or a computer for constructing various information display/reproduction apparatuses.

EXAMPLES

In the following examples of the present invention will be explained in detail.

Example 1

An electron emitting film was prepared according to the producing method shown in FIGS. 17A to 17D.

Figure 17A:
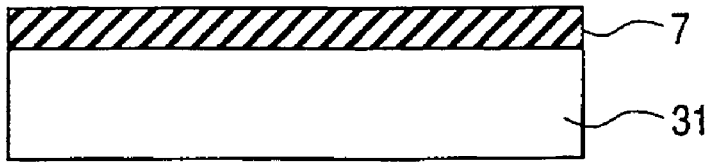
FIGS. 17A, 17B, 17C and 17D are schematic cross sectional views showing a producing method for the electron emitting device of the present invention.
Figure 17B:
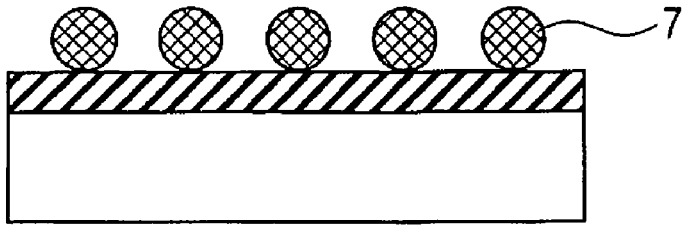

Quartz was employed as the substrate 31, which was rinsed well and subjected to formation of a TiN film of a thickness of 500 nm as the cathode electrode 1 by sputtering (FIG. 17A). The employed film forming conditions were as follows:

Rf power source: 13.56 MHz
Rf power: 7.7 W/cm$^2$
gas pressure: 0.6 Pa
gas atmosphere: $N_2$/Ar ($N_2$:10%)
substrate temperature: room temperature
target: Ti Then, on the cathode electrode 1, Pt eloctroconductive particles 7 were formed, as shown in FIG. 17B, by sputtering under following conditions:

Rf power source: 13.56 MHz
Rf power: 300 W
gas atmosphere: Ar
substrate temperature: 150° C.
target: Pt An observation of the surface of the cathode electrode 1 under an electron microscope revealed that fine Pt particles of an average particle size of 10 nm were formed with a density of $8\times10^5$/mm$^2$ on the cathode electrode 1.

Figure 18A:
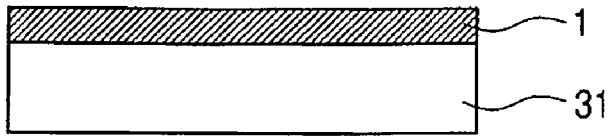
FIGS. 18A, 18B, 18C, 18D, 18E and 18F are schematic cross sectional views showing a producing method for the electron emitting device of the present invention.
Figure 18B:
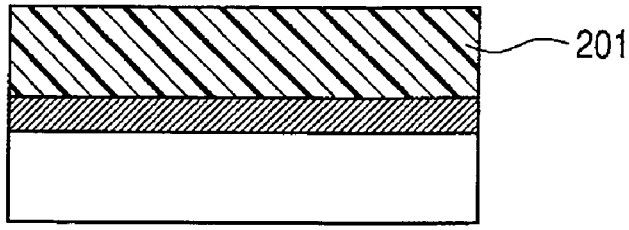
Figure 18C:
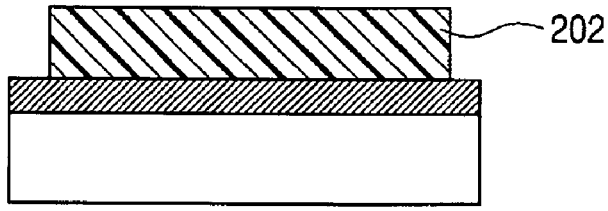

Then a carbon film was deposited on the cathode electrode 1 and the electroconductive particles 7 by 4 nm by sputtering to form the insulation layer 2 (FIG. 18C). The film formation was conducted in an atmosphere of argon and hydrogen, utilizing a graphite target.

An observation of the surface of the cathode electrode 1 under an electron microscope revealed that a carbon film constituting the insulation layer 2 covered the electroconductive particles 7 and the cathode electrode 1.

Figure 10A:
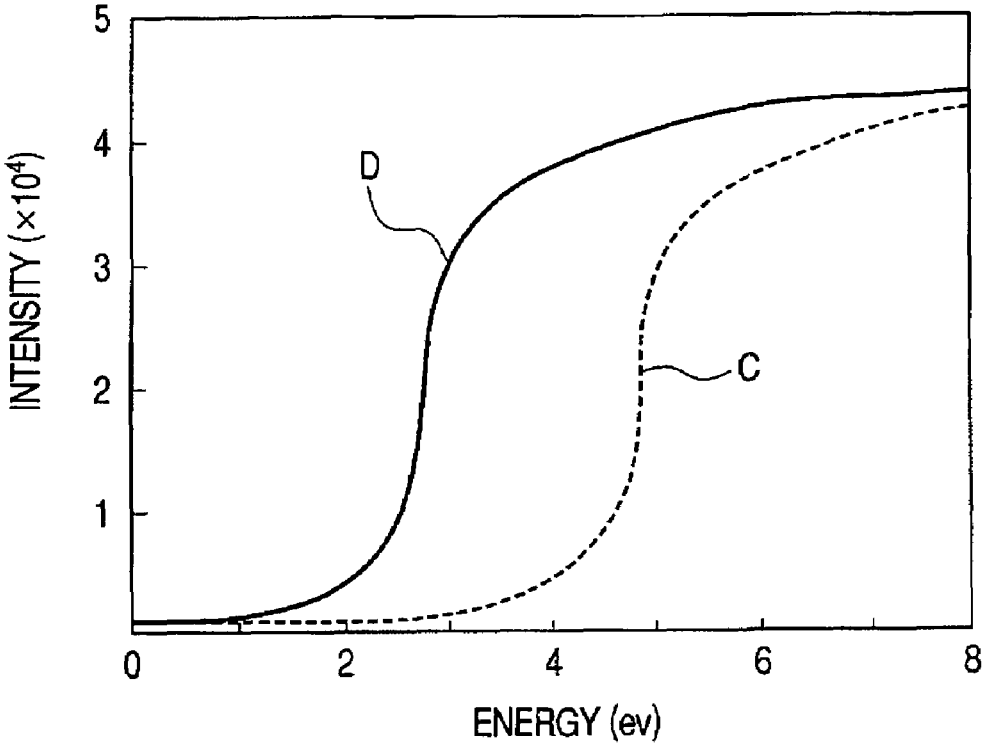
FIGS. 10A and 10B are charts showing SES spectra of an insulation layer in an embodiment 1 of the present invention.
Figure 17C:
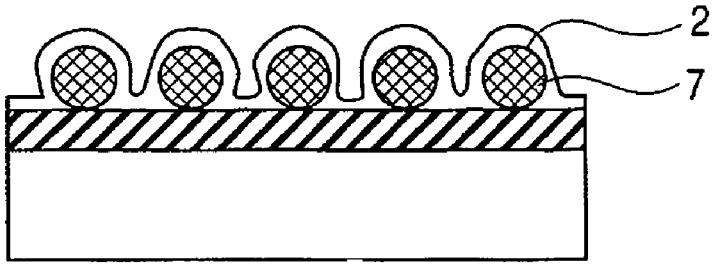
Figure 17D:
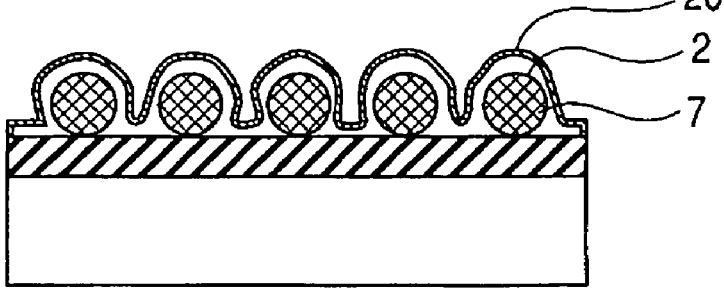

Then the insulation layer 2 was heat treated in a mixed gas atmosphere of methane and hydrogen to form a dipole layer on the surface (FIG. 17D). The conditions of heat treatment were as follows:

heat treating temperature: 600° C.
heating method: lamp heating
treating time: 60 min
gas mixing ratio: methane/hydrogen=15/6
heat treating pressure: 6.65 KPa A secondary electron energy spectrum (hereinafter represented as "SES") of the insulation layer 2 provided with the dipole layer 20 and obtained in the above-described method is schematically shown in FIG. 10A.

The SES is obtained by irradiating a specimen with an electron beam and measuring an energy distribution of the emitted secondary electrons, and a work function of the measured specimen can be estimated from the segment of SES.

Figure 10B:
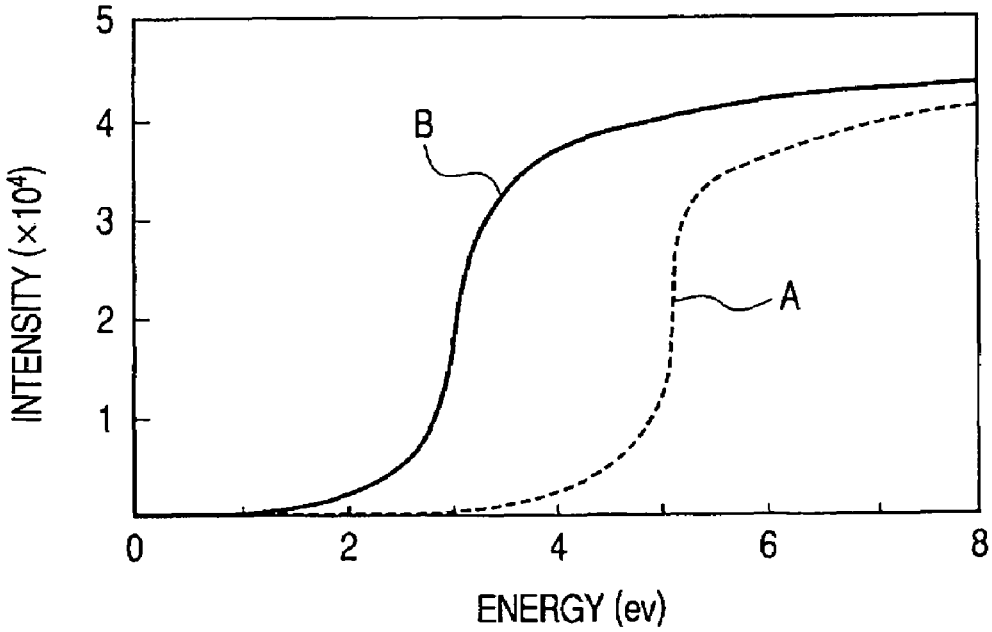

Also FIG. 10B schematically shows SES of a diamond-like carbon (DLC) as a reference. In FIG. 10B, A indicates the SES of a DLC film, and B indicates the SES measured in a state where a bias of 2 V is applied to the DLC film. As shown in FIG. 10B, when a potential is applied onto the surface of the DLC film, an apparent work function thereof is reduced by such applied potential.

In the electron emitting device of the present invention, the dipole layer formed on the surface of the insulation layer causes a bending of an energy band, thereby facilitating the electron emission. If such situation exists actually, the SES of the specimen will provide a result of measurement as if a potential is applied to the surface, as shown in FIG. 10B.

In FIG. 10A, D shows the SES of the insulation layer provided with the dipole layer, prepared in the present example, and C indicates the SES of an insulation layer not subjected to the surfacial heat treatment and not provided with the dipole layer. In FIG. 10A, the work function estimated from the SES decreases by about 2 eV by the aforementioned heat treatment. In combination with the result of FIG. 10B, it is estimated that the surface of the insulation layer is chemically modified with hydrogen as explained in FIG. 2 by the heat treatment thereby forming a dipole layer, whereby the work function shows a decrease.

Figure 11:
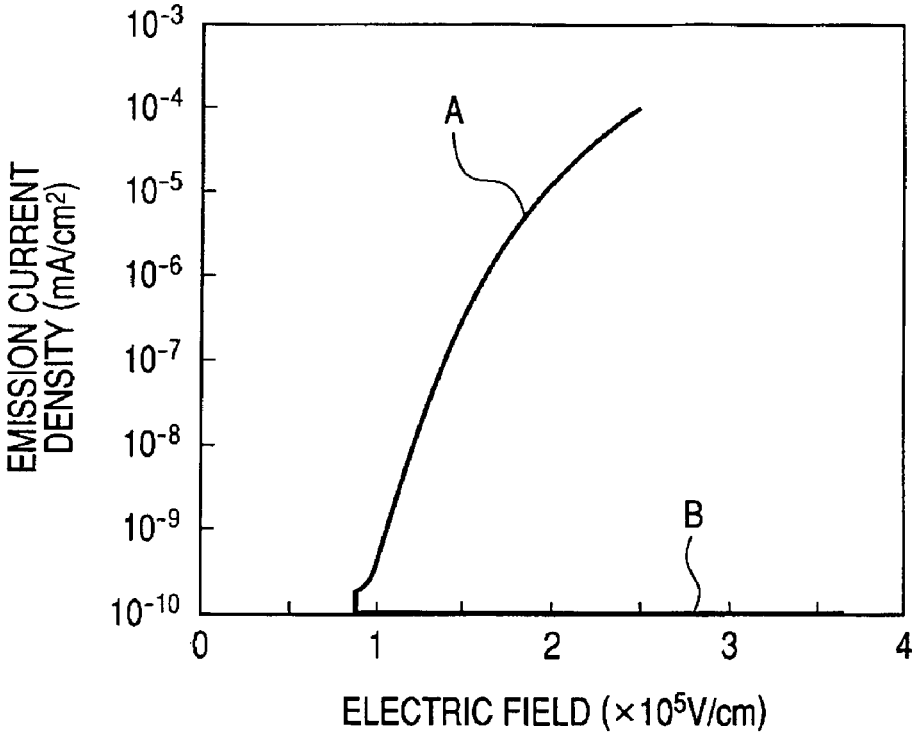
FIG. 11 is a chart showing current-voltage characteristics at an electron emission in the insulation layer in the embodiment 1 of the present invention.

Then the insulation layer prepared in this example was subjected to a measurement of electron emitting characteristics. An anode electrode (area: 1 mm$^2$) was positioned with a space to the insulation layer prepared in the present example, and a driving voltage was applied between the anode electrode and the cathode electrode. Voltage-current characteristics obtained in this state are shown in FIG. 11, in which the abscissa indicates an electric field strength, and the ordinate indicates an emission current density. In FIG. 11, A indicates voltage-current characteristics of the insulation layer with the dipole layer, prepared in the present example, and B indicates voltage-current characteristics of an insulation layer not subjected to the heat treatment in the atmosphere of methane and hydrogen and not provided with the dipole layer.

The electron emitting device including the insulation layer 2 with the dipole layer 20 on the electroconductive particles 7, prepared in the present example, was confirmed to showing satisfactory electron emitting characteristics with a clear threshold field and capable of emitting electrons with a low field strength. Also there was realized an electron emitting film with a high electron emitting density and with little fluctuation.

Example 2

An insulation layer 2 of the present invention including electroconductive particles 7 and provided with a dipole layer 20 was prepared according to the producing method shown in FIGS. 17A to 17D.

Quartz was employed as the substrate 31, which was rinsed well and subjected to formation of a W film of a thickness of 500 nm as the cathode electrode 1 by sputtering (FIG. 17A).

Then, on the cathode electrode 1, Co electroconductive particles 7 were formed, as shown in FIG. 17B, by sputtering under following conditions:

Rf power source: 13.56 MHz
Rf power: 300 W
gas atmosphere: Ar
substrate temperature: 150° C.
target: Co An observation of the surface of the cathode electrode 1 under an electron microscope revealed that fine Co particles of an average particle size of 6 nm were formed with a density of $1\times10^6/mm^2$ on the cathode electrode 1.

Then $SiO_2$ was deposited on the cathode electrode 1 by 5 nm by sputtering to form the insulation layer 2 (FIG. 17C). The deposition was conducted in a 1/1 gas mixture of Ar and $O_2$, under following conditions:

Rf power source: 13.56 MHz

Rf power: 110 $W/cm^2$ substrate temperature: 300° C.

target: $SiO_2$

Then the substrate was heat treated in a mixed gas atmosphere of methane and hydrogen to form a dipole layer 20 on the surface of the insulation layer (FIG. 17D). The conditions of heat treatment were as follows:

heat treating temperature: 600° C.

heating method: lamp heating treating time: 60 min gas mixing ratio: methane/hydrogen=15/6 heat treating pressure: 7 KPa.

Then the insulation layer prepared in this example was subjected to a measurement of electron emitting characteristics. An anode electrode was positioned with a space to the insulation layer prepared in the present example, and a driving voltage was applied between the anode electrode and the cathode electrode. As a result, as in Example 1, there were obtained satisfactory electron emitting characteristics with a clear threshold field and capable of emitting electrons with a low field strength.

Example 3

As in Example 1, quartz was employed as the substrate 31, which was rinsed well and subjected to formation of a TiN film of a thickness of 500 nm as the cathode electrode 1 by sputtering.

Then on the cathode electrode 1, a Pt film of a thickness of 15 nm was formed by sputtering under following conditions:

Rf power source: 13.56 MHz

Rf power: 300 W gas atmosphere: Ar substrate temperature: room temperature target: Pt Then the Pt film was heated in a hydrogen atmosphere to form granules. An observation of the surface of the cathode electrode 1 revealed that Pt particles of an average particle size of 20 nm were formed with a density of $4\times10^7/mm^2$ on the cathode electrode 1.

Then a carbon film was formed by inclined evaporation on the cathode electrode 1 and the Pt particles 7, thereby forming an insulation layer 2 of a carbon film. The carbon film was formed on the electroconductive particles 7 and the cathode electrode 1, but was scarcely formed in shadow portions of the Pt electroconductive particles as shown in FIG. 19, thereby forming an insulation layer 2 of a thickness of 10 nm or less on the Pt electroconductive particles 7.

Then the insulation layer 2 formed on the Pt electroconductive particles was heat treated in a mixed gas atmosphere of methane and hydrogen as in Example 1 to form a dipole layer 20 constituted by hydrogen termination of the surface of the insulation layer 2.

The electron emitting film prepared in the producing method of the present example was confirmed to show satisfactory electron emitting characteristics, with an electron emitting site density larger than in Example 1.

Example 4

As in Example 1, quartz was employed as the substrate 31, which was rinsed well and subjected to formation of a TiN film of a thickness of 500 nm as the cathode electrode 1 by sputtering.

Then, a dispersion of electroconductive particles 7 of Pd—Co alloy, prepared in advance, was coated on the cathode electrode 1. Thereafter the solvent was eliminated by heating, thereby forming the electroconductive particles 7 of Pd—Co alloy on the cathode electrode 1. The electroconductive particles 7 of Pd—Co alloy formed in this method were anisotropic electroconductive particles with a short axis of 5 nm and a long axis of 15 nm (cf. FIG. 20).

Then a DLC film as the insulation layer 2 was formed on the cathode electrode 1 and the electroconductive particles 7 by hot-filament CVD under following conditions:

gas: $CH_4$ gas pressure: 267 mPa substrate temperature: room temperature substrate bias: −50 V filament temperature: 2100° C.

The DLC film covered the electroconductive particles 7 and the cathode electrode 1 to constitute an insulation layer 2 of a thickness of 6 nm at maximum on the electroconductive particles 7 of Pd—Co alloy.

Then a heat treatment in a mixed gas atmosphere of methane and hydrogen was conducted as in Example 1 to form a dipole layer 20 constituted by hydrogen termination of the surface of the insulation layer 2. The electron emitting film prepared in the producing method of the present example was confirmed to show satisfactory electron emitting characteristics, with a high electron emitting site density of $3\times10^5/mm^2$.

Example 5

As in Example 1, quartz was employed as the substrate 31, which was rinsed well and subjected to formation of a TiN film of a thickness of 500 nm as the cathode electrode 1 by sputtering.

Then, a DLC film as the insulation layer 2 was formed by 40 nm on the cathode electrode 1 by HF-CVD under following conditions:

gas: $CH_4$ substrate temperature: room temperature substrate bias: −50 V filament temperature: 2100° C.

Then cobalt was implanted by ion implantation under conditions of 25 keV and a dose of $5\times10^{16}/cm^2$.

Then the DLC film implanted with cobalt was annealed at 650° C. in a hydrogen atmosphere to form the implanted cobalt into electroconductive particles, thereby forming an insulation layer containing a plurality of Co electroconductive particles.

In an observation under a transmission electron microscope, cobalt particles of a particle size of 4 nm were observed, within a film thickness of 40 nm, deeper (at the side of the cathode electrode) than a depth of 15 nm from the surface. This is because the distribution of ion implantation generates a distribution of metal concentration, depending on the implanting energy.

Then the DLC film was eliminated from the surface thereof to a depth of 10 nm by dry etching.

Then the etched DLC film was heat treated in a mixed gas atmosphere of methane and hydrogen as in Example 1 to form a dipole layer 20 constituted by hydrogen termination of the surface of the insulation layer (DLC film).

Also the electron emitting film prepared in the present example showed satisfactory electron emitting characteristics as in Example 1.

Also it was found that a regulation on the amount of dry etching could realize an electron emission at a lower voltage and could increase ESD.

Example 6

As in Example 1, quartz was employed as the substrate 31, which was rinsed well and subjected to formation of a TiN film of a thickness of 500 nm as the cathode electrode 1 by sputtering (FIG. 18A).

Then, as shown in FIG. 18B, a photosensitive resin film 201 was formed on the cathode electrode, and was dried by heating on a hot plate.

Then an exposure was executed through a negative photomask. Then the resin was developed to obtain a resin pattern of a desired form (FIG. 18B).

Figure 18D:
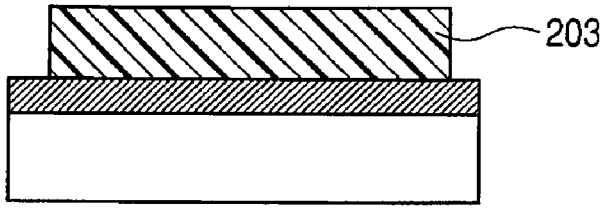
Figure 18E:
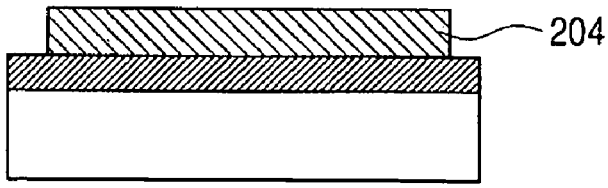

Then the substrate 31 bearing the resin pattern was immersed in a Pt complex solution. Thereafter the substrate 31 was taken out, rinsed and dried (FIG. 18D).

Then a heat treatment was conducted in vacuum at 600° C., thereby obtaining a carbon film 204 containing a plurality of Pt particles of a particle size of 4 nm therein. Pt concentration in the film 2 was 12 atm. %, and the film thickness was 15 nm (FIG. 18C).

In the present example, the photosensitive resin film was modified to an insulating carbon film by the heat treatment, and Pt impregnated in the resin film by the immersion thereof in the Pt complex film constituted Pt electroconductive particles in the carbon film.

Figure 18F:
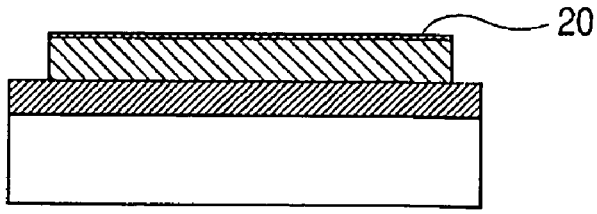

Then a heat treatment in a mixed gas atmosphere of methane and hydrogen was conducted as shown in FIG. 18F to form a dipole layer 20 constituted by hydrogen termination of the surface of the insulation layer (carbon film).

The electron emitting film prepared in the present example showed satisfactory electron emitting characteristics as in Example 1.

Example 7

An electron emitting film was prepared according to the producing method shown in FIGS. 17A to 17D.

(Step 1)

Quartz was employed as the substrate 31, which was rinsed well and subjected to formation of a TiN film of a thickness of 500 nm as an electrode layer 71 by sputtering.

(Step 2)

A carbon layer 2 containing a plurality of Pt electroconductive particles 7 by a method shown in Example 6 (FIG. 7A).

(Step 3)

Then as shown in FIG. 7B, a photolithographic process was conducted by spin coating a positive photoresist (AZ1,500, manufactured by Clariant), followed by an exposure by a photomask pattern and a development to obtain a mask pattern (resist 72).

(Step 4)

A dry etching was conducted as shown in FIG. 7C on the carbon film containing plurality of Pt electroconductive particles 7 and the TiN electrode in continuation, utilizing the mask pattern as an etching mask. In order to reduce a leak by carbon, generated in a very small amount in the heat treatment of gate electrode and cathode electrode, the etching was conducted in an over-etching level so as to slightly etch the quartz.

(Step 5)

The mask pattern was completely eliminated as shown in FIG. 7D.

(Step 6)

Figure 12:
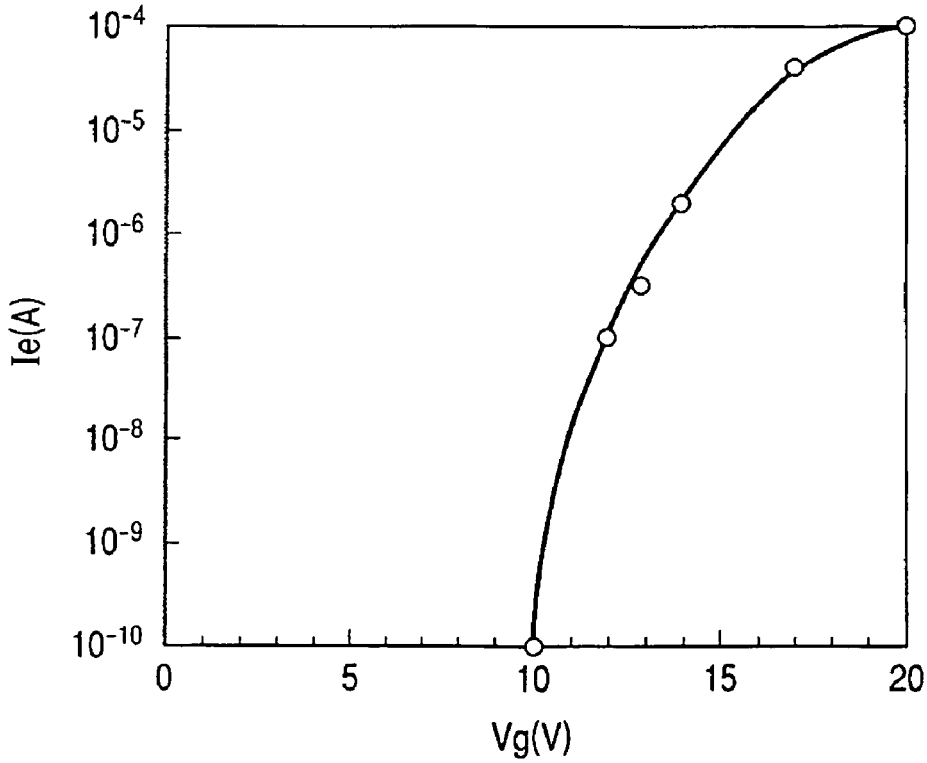
FIG. 12 is a chart showing current-voltage characteristics of an electron emitting device in an embodiment 3 of the present invention.
Figure 13:
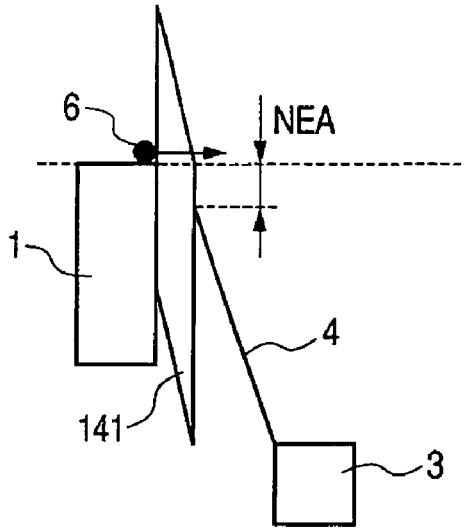
FIG. 13 is an energy band diagram for explaining an electron emitting principle of a prior electron emitting device.
Figure 14:
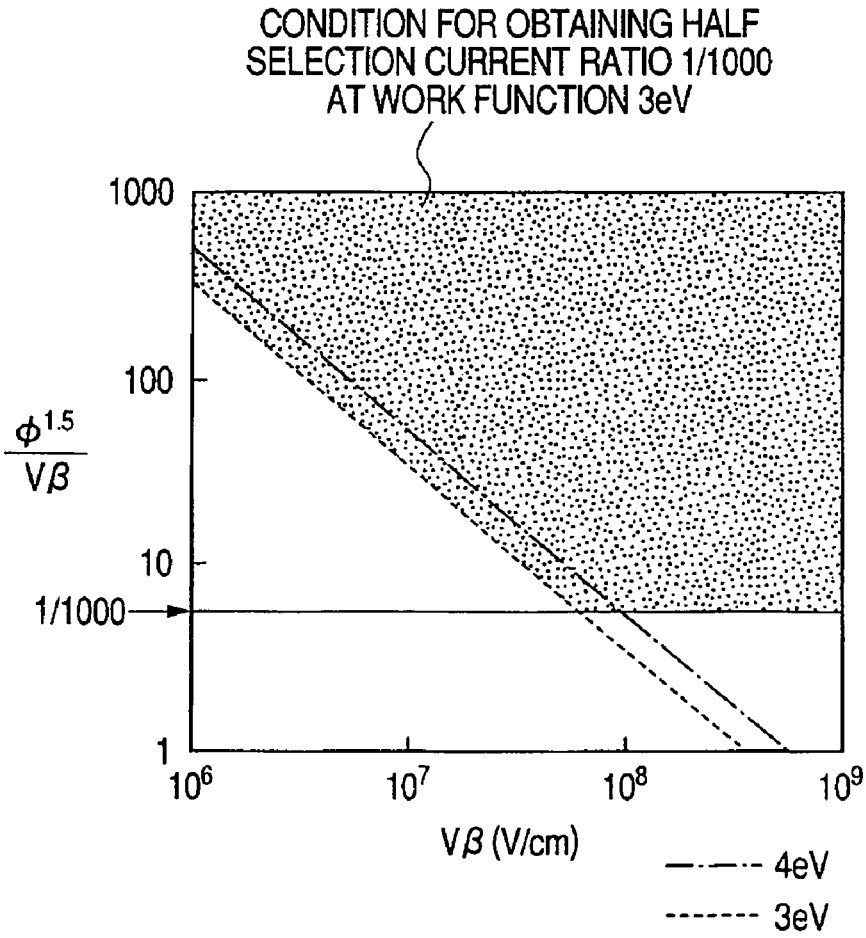
FIG. 14 is a chart showing a range in which a contrast ratio of 1/1000 can be obtained in an electron emitting device of the present invention.

Finally, the substrate was subjected to a heat treatment in a mixed gas atmosphere of methane and hydrogen as shown in FIG. 7C to form a dipole layer 20 on the surface of the insulation layer 2 constituted of a carbon film, thereby completing an electron emitting device. The conditions of the heat treatment were as follows:

heat treating temperature: 600° C.
heating method: lamp heating
treating time: 60 min
gas mixing ratio: methane/hydrogen=15/6
heat treating pressure: 6 KPa An anode electrode 3 was positioned above thus prepared electron emitting device, which was then driven by applying voltages between the cathode electrode 1 and the gate electrode 32 and to the anode electrode 33. FIG. 12 shows the voltage-current characteristics of the electron emitting device. The electron emitting device of the present example could emit electrons at a low voltage, and could show a clear threshold. The actual driving voltages were Vg (between the cathode electrode 1 and the gate electrode 32)=20 [V] and Va (between the anode electrode 33 and the cathode electrode 1)=10 kV.

Example 8

An image display apparatus was prepared with the electron emitting device prepared in Example 7.

An electron source was constructed by arranging the electron emitting devices prepared in Example 7 in 100×100 units in a matrix arrangement. As shown in FIG. 8, X-wirings 82 were connected to the cathodes 1, and Y-wirings 83 were connected to the gate electrodes 32. In FIG. 8, the electron emitting device 84 is shown a structure of providing a gate electrode 32 having an aperture 85 on a cathode electrode 1, but the electron emitting device of the image display apparatus of the present example does not correspond to such structure. The present example was same in configuration as that schematically shown in FIG. 8, except for the structure of the electron emitting device (having a structure of Example 3). The electron emitting devices of the present example were arranged with a pitch of 300 μm in the lateral direction of 300 μm in the vertical direction. Above each electron emitting device, there was provided a phosphor among the phosphors emitting lights of red, blue and green.

The aforementioned electron source was line-sequentially driven to display an image, thereby providing an image display of a high contrast, a high luminance and a high definition.

Example 9

(Step 1)

Quartz was employed as the substrate 31, which was rinsed well and subjected to formation of a TiN film of a thickness of 500 nm as an electrode layer 71 by sputtering as shown in FIG. 15A.

(Step 2)

Then a carbon film of a thickness of 50 nm was formed as a resistance layer 16 by sputtering. The carbon film was so regulated as to have a resistance of $1\times10^6$ Ω:

target: graphite gas: Ar

RF power: 500 W (Step 3)

Then a carbon layer 2 containing electroconductive particles was formed by a method as in Example 6 (FIG. 15A).

(Step 4)

Then, as shown in FIG. 15B, a photlithographic process was conducted by spin coating a positive photoresist (AZ1500, manufactured by Clariant), followed by an exposure by a photomask pattern and a development to obtain a mask pattern (resist 72).

(Step 5)

A dry etching was conducted as shown in FIG. 15C on the insulating layer 2 containing the electroconductive particles 7, the resistance layer 161 and the electrode layer 71 in continuation, utilizing the mask pattern as an etching mask. The etching was conducted in an over-etching level so as to slightly etch the quartz. In the present example, the aperture 73 had a width W of 2 μm.

(Step 6)

The mask pattern was completely eliminated as shown in FIG. 15D. The film had little stress and did not cause a film peeling or other difficulties in process.

(Step 7)

Finally, the substrate was subjected to a heat treatment by a lamp heating for 60 minutes at 600° C. in a mixed gas atmosophere of methane and hydrogen as shown in FIG. 15E to form a dipole layer 20, thereby completing an electron emitting device.

An anode electrode was positioned above thus prepared electron emitting device, which was then driven as in Example 8. As a result, the electron emitting device of the present example showed an alleviated change in time of the emission current at the electron emission, in comparison with the electron emitting device of Example 8.

Example 10

(Step 1)

Quartz was employed as the substrate 31, which was rinsed well and subjected to formation of a TiN film of a thickness of 500 nm as an electrode layer 71 by sputtering as shown in FIG. 16A.

(Step 2)

Then, as shown in FIG. 16B, a photolithographic process was conducted by spin coating a positive photoresist (AZ1500, manufactured by Clariant), followed by an exposure by a photomask pattern and a development to obtain a mask pattern (resist 72).

(Step 3)

A dry etching was conducted as shown in FIG. 16C on the electrode layer 71, utilizing the mask pattern as an etching mask. The etching was conducted in an over-etching level so as to slightly etch the quartz. Thereafter the mask was eliminated as shown in FIG. 16D.

(Step 4)

Then a carbon film of a thickness of 50 nm was formed as a resistance layer 16 by sputtering. The carbon film was so regulated as to have a resistance of $1\times10^7$ Ω:

target: graphite gas: Ar

RF power: 500 W (Step 5)

Then a carbon layer 2 containing a plurality of Pt electroconductive particles was formed by a method as in Example 6 (FIG. 16E).

(Step 6)

Then, as shown in FIG. 16F, a photolithographic process was conducted by spin coating a positive photoresist (AZ1500, manufactured by Clariant), followed by an exposure by a photomask pattern and a development to obtain a mask pattern (resist 72').

(Step 7)

A dry etching was conducted as shown in FIG. 16G on the carbon layer 2 containing the Pt electroconductive particles 7, and the resistance layer 161 in continuation, utilizing the mask pattern as an etching mask. Then the mask pattern was completely eliminated. In the present example, the aperture 73 had a width W of 1 μm. The film had little stress and did not cause a film peeling or other difficulties in process.

(Step 8)

Finally, the substrate was subjected to a heat treatment by a lamp heating for 60 minutes at 600° C. in a mixed gas atmosophere of methane and hydrogen as shown in FIG. 16H to form a dipole layer 20, thereby completing an electron emitting device.

An anode electrode was positioned above thus prepared electron emitting device, which was then driven as in Example 9. As a result, the electron emitting device of the present example showed an even more alleviated change in time of the emission current at the electron emission, in comparison with the electron emitting device of Example 9.

Example 11

Electron sources were prepared by arranging a plurality of electron emitting devices respectively prepared in Examples 9 and 10, and an image display apparatus was prepared with the respective electron source.

Each electron source was prepared in the same manner as in Example 8 except for the structure of the electron emitting devices. Each electron source when driven line-sequentially could display an image of an excellent contrast, a high luminance and a high definition, in stable manner over a prolonged period.

This application claims priority from Japanese Patent Application No. 2004-358362 filed on Dec. 10, 2004, which is hereby incorporated by reference herein.

What is claimed is:

1. A method for producing an electron-emitting device comprising steps of:

preparing a plurality of electroconductive particles each covered with an insulation material having a thickness of 10 nm or less at least on a part of a surface of the particles; and forming a dipole layer on a surface of the insulation material covering each of the plurality of electroconductive particles, wherein the step of preparing a plurality of electroconductive particles each covered with an insulation material includes:

preparing a resin layer;

making the resin layer absorb a metal which constitutes electroconductive material through an ion exchange; and converting the resin layer into an insulation material layer containing electroconductive particles, by baking the resin layer for decomposing an organic component in the resin.

2. The method according to claim 1, wherein the insulation material is principally constituted of carbon.

3. The method according to claim 1, wherein a material constituting the insulation material has a resistivity of $1\times10^{8}$ Ω·cm or higher.

4. The method according to claim 3, wherein a material constituting the insulation material has a resistivity of $1\times10^{14}$ Ω·cm or less.

5. The method according to claim 1, wherein the electroconductive particles are metal particles.

6. The method according to claim 1, wherein the plurality of electroconductive particles has a density of $10^{4}$ particles/$mm^{2}$ or higher.

7. The method according to claim 1, wherein the plurality of electroconductive particles has a density of $10^{6}$ particles/$mm^{2}$ or higher.

8. The method according to claim 1, wherein the dipole layer is formed by executing a hydrogen germination process on a surface of the insulation layer.

9. A method for producing an electron source having a plurality of electron emitting devices, wherein each of the plurality of electron emitting devices is produced by a method according to claim 1.

10. A method for producing an image display apparatus including an electron source and a light emitting member capable of emitting light by an irradiation with electrons emitted from the electron source, wherein the electron source is produced by a method according to claim 9.

* * * * *